US012589837B2

(12) United States Patent
Doyle et al.

(10) Patent No.: US 12,589,837 B2
(45) Date of Patent: Mar. 31, 2026

(54) BUOYANT ROTATABLE MARINE TRANSDUCER

(71) Applicant: Dublin Offshore Consultants Ltd, Dublin (IE)

(72) Inventors: Thomas Doyle, Dublin (IE); Danny Golden, Dublin (IE); Darren Hayes, Dublin (IE)

(73) Assignee: Dublin Offshore Consultants Ltd, Dublin (IE)

( * ) Notice: Subject to any disclaimer, the term of this patent is extended or adjusted under 35 U.S.C. 154(b) by 1150 days.

(21) Appl. No.: 17/616,402

(22) PCT Filed: Jun. 2, 2020

(86) PCT No.: PCT/EP2020/065223
§ 371 (c)(1),
(2) Date: Dec. 3, 2021

(87) PCT Pub. No.: WO2020/245120
PCT Pub. Date: Dec. 10, 2020

(65) Prior Publication Data

US 2022/0242529 A1 Aug. 4, 2022

(30) Foreign Application Priority Data

Jun. 4, 2019 (GB) ..... 1907959

(51) Int. Cl.
*B63B 21/50* (2006.01)
*B63J 3/04* (2006.01)
(Continued)

(52) U.S. Cl.
CPC ..... *B63B 21/50* (2013.01); *B63J 3/04* (2013.01); *B63B 2021/005* (2013.01); *B63B 2021/505* (2013.01); *B63J 2003/002* (2013.01)

(58) Field of Classification Search
CPC ..... B63H 21/50; B63H 2021/50; B63H 2021/505; B63H 2021/005
See application file for complete search history.

(56) References Cited

FOREIGN PATENT DOCUMENTS

AU 2010252719 A1 * 12/2011 ..... F03B 13/183
CA 1223486 A * 6/1987 ..... B63B 39/03
(Continued)

*Primary Examiner* — S. Joseph Morano
*Assistant Examiner* — Jovon E Hayes
(74) *Attorney, Agent, or Firm* — Leech Tishman Fuscaldo & Lampl, LLC

(57) ABSTRACT

The present invention is concerned with a buoyant rotatable marine transducer and a load reduction device defined by the buoyant rotatable marine transducer, and in particular a load reduction device for use in securing an offshore structure such as a floating platform or the like, as are common in the areas of marine renewables, oil and gas applications, aquaculture, the buoyant rotatable marine transducer having a buoyant body adapted to assume a first orientation when at least partially submerged in a body of water and unloaded, in which a longitudinal axis of the body is disposed substantially vertically, and first and second mooring connection points provided on the body wherein at least the first mooring connection point is positioned such that a load applied via the first mooring connection point to the body acts off axis of the longitudinal axis.

47 Claims, 37 Drawing Sheets

(51) Int. Cl.
*B63B 21/00* (2006.01)
*B63J 3/00* (2006.01)

(56) References Cited

FOREIGN PATENT DOCUMENTS

| | | | | | |
|---|---|---|---|---|---|
| GB | 1363785 | A | * | 8/1974 | ..... B63B 21/50 |
| JP | 62241790 | A | * | 10/1987 | |
| SU | 1134467 | A1 | * | 1/1985 | |

* cited by examiner

BUOYANT ROTATABLE MARINE TRANSDUCER

CROSS-REFERENCE TO RELATED APPLICATIONS

This application is a submission under 35 U.S.C. § 371 for U.S. National Stage Patent Application of, and claims priority to, International Application Number PCT/EP2020/065223 entitled A BUOYANT ROTATABLE MARINE TRANSDUCER filed Jun. 2, 2020, which is related to and claims priority to Great Britain Application No. 1907959.9, filed Jun. 4, 2019, the entirety of all of which are incorporated herein by reference.

FIELD OF THE INVENTION

The present invention is concerned with a buoyant rotatable marine transducer for converting one form of energy or motion into another, and having application as a load reduction device and system, in particular a load reduction device for use in securing an offshore structure such as a floating, submerged or semi-submerged platform or the like, as are common in the areas of marine renewables, oil and gas applications, aquaculture, and any other related fields, and which load reduction device is preferably tuneable to enable various stiffness responses to be achieved.

Such marine structures may for example be oil or gas platforms, a platform or similar support for a wind turbine or submerged tidal turbine, a mid-water arch, or any other structure required to be moored in a particular location.

The present invention is also concerned with a sensor system incorporating such a buoyant rotatable marine transducer, and in particular a self powered sensor system operable to record data relating to the local marine environment, operational and other data relating to a system to which the sensor system is connected or an integral part, and to transmit that data to a remote location for real time monitoring or subsequent review.

The present invention is further concerned with a floating platform incorporating such a buoyant rotatable marine transducer as an integral load reduction device.

BACKGROUND OF THE INVENTION

Offshore floating platforms or similar marine structures which require mooring are generally subjected to severe environmental conditions, and as a result the mooring systems utilised to secure such marine structures are consequently also subjected to extreme operational loading. For example wave induced motion of floating structures results in significant shock loading applied to the mooring connection point on the platform, as the mooring line securing the platform alternates between slack and taut states as a result of the undulations imparted by the motion of the passing waves.

Wind and tidal forces also apply additional loading to the mooring, which again can be very significant and also intermittent, increasing the peak and shock loads transferred to the platform, and in combination the loading and forces that such marine platforms must endure are very significant and can cause damage to the platform and or mooring, and may ultimately result in a failure of the mooring and a consequent loss of the platform.

It is therefore an object of the present invention to provide a buoyant rotatable marine transducer operable to function as a load reduction device, and a load reduction system employing at least one of the load reduction devices, which are adapted to effect a reduction in load transmission to a moored floating platform or the like and smoothing out or attenuating peak loads, shock loading, fatigue loading and the like, and which are compatible with all known mooring types including catenary, semi-taut and taut moorings.

It is a further object of the present invention to provide a sensor system comprising such a buoyant rotatable marine transducer in order to provide power to one or more sensors such as to facilitate the acquisition of data which can be transmitted to a remote location such as an onshore facility or the like for real time monitoring or future assessment, or for example to enable feedback control of a system to which the sensor system is connected or integrally formed.

SUMMARY OF THE INVENTION

According to a first aspect of the present invention there is provided a buoyant rotatable marine transducer comprising a body adapted to assume a first orientation when at least partially submerged in a body of water and unloaded, in which a longitudinal axis of the body is disposed in a nominal orientation; first and second mooring connection points provided on the body; wherein at least the first mooring connection point is positioned such that a load applied via the first mooring connection point to the body acts off axis of the longitudinal axis.

Preferably, the body is adapted to undergo displacement when a load is applied to the body via the first and second mooring connection points and to return to the first orientation when the load is removed.

Preferably, the body is adapted to undergo rotational displacement when a load is applied.

Preferably, the body is shaped to maximise and/or control drag during displacement of the body under the influence of the applied load.

Preferably, the body is shaped to minimise and/or control drag during return of the body to the first orientation.

Preferably, the body is adapted to undergo rotational displacement about an axis of rotation extending through a point within or outside the body.

Preferably, the second mooring connection point is positioned such that a load applied via the second mooring connection point to the body acts off axis of the longitudinal axis.

Preferably, the location of at least the first mooring connection point on the body is adjustable.

Preferably, the location of the first mooring connection point is adjustable longitudinally and/or radially of the body.

Preferably, the location of the second mooring connection point on the body is adjustable.

Preferably, the location of the second mooring connection point is adjustable longitudinally and/or radially of the body.

Preferably, the location of at least the first mooring connection point is longitudinally spaced from a centre of gravity of the body.

Preferably, the location of at least the first mooring connection point is longitudinally spaced from a centre of buoyancy of the body.

Preferably, the location of the second mooring connection point is longitudinally spaced from the centre of gravity of the body.

Preferably, the location of the second mooring connection point is longitudinally spaced from the centre of buoyancy of the body.

Preferably, the first and second mooring connection points, the centre of gravity of the body and the centre of buoyancy of the body are arranged in a linear array.

Preferably, the body is neutrally buoyant.

Preferably, the body is positively buoyant.

Preferably, the body is negatively buoyant.

Preferably, the body comprises a weighted portion.

Preferably, the body comprises a buoyant portion.

Preferably, the body comprises a buoyant portion and a weighted portion.

Preferably, the buoyant portion and the weighted portion are positioned such as to establish a force couple which together act to restore the body towards the first orientation.

Preferably, the buoyant portion and the weighted portion are longitudinally spaced from one another.

Preferably, the buoyancy of the body is adjustable.

Preferably, the buoyant rotatable marine transducer comprises an energy capture take off system.

Preferably, the energy capture take off system is operable to generate electrical energy in response to rotation of the body.

Preferably, the electrical energy supplies one or more powered components provided in or on the marine transducer.

Preferably, the buoyant rotatable marine transducer comprises one or more sensors.

Preferably, the buoyant rotatable marine transducer comprises a transmitter operable to wirelessly transmit data acquired from the one or more sensors.

Preferably, the body comprises two or more sections.

Preferably, at least one of the body sections is articulated relative to another body section.

Preferably, the buoyant rotatable marine transducer comprises one or more fairleads extending outwardly from the body in order to facilitate alteration of the point at which a load applied from one or more mooring lines secure to the first and/or second mooring connection points acts on the body when undergoing rotation.

Preferably, the buoyant rotatable marine transducer comprises one or more springs arranged for compression in response to rotation of the body such as to tune the stiffness response of the body.

Preferably, the body defines a passage extending between the first and second mooring connection points.

Preferably, the body is operable to clamp a mooring line or cable such as to restrict or prevent displacement of the mooring line through the passage.

Preferably, one or both ends of the passage terminate in a bend restrictor.

Preferably, the body is openable to permit exterior access to the full length of the passage.

Preferably, the position of one or more of the mooring connection points and/or a level or position of ballast in the body and/or a level or position of buoyancy of the body are dynamically controllable autonomously and/or in response to a signal from the one or more of the sensors and/or in response to external information.

Preferably, the buoyant rotatable marine transducer comprises a load reduction device for reducing or managing the load or tension in a mooring line securing a floating platform.

According to a second aspect of the present invention there is provided a load reduction device for reducing or managing the load or tension in a mooring line securing a floating platform or the like, the load reduction device comprising the buoyant rotatable marine transducer according to the first aspect of the invention.

According to a third aspect of the present invention there is provided a load reduction system for securing a floating structure, the load reduction system comprising at least one buoyant rotatable marine transducer according to the first aspect of the invention; a first mooring line connected between the floating structure and the body of the buoyant rotatable marine transducer; and a second mooring line connected between the body of the buoyant rotatable marine transducer and an anchor.

According to a fourth aspect of the present invention there is provided a floating platform comprising at least one rotatable buoyant marine transducer according to the first aspect of the invention formed integrally therewith, wherein the rotatable buoyant marine transducer is rotatably mounted to the platform at one of the first or second mooring points.

Preferably, the body of the rotatable buoyant marine transducer comprises a buoyant portion above the mooring point at which the body is rotatably mounted to the platform and/or a weighted portion below the mooring point at which the body is rotatably mounted to the platform.

Preferably, the body of the at least one rotatable buoyant marine transducer comprising an effective amount of the buoyancy and displacement required to float the floating platform.

According to a fifth aspect of the present invention there is provided a sensor system comprising at least one rotatable buoyant marine transducer according to the first aspect of the invention.

According to a sixth aspect of the present invention there is provided method of mooring a floating platform comprising the steps of securing one or more of the rotatable buoyant marine transducers according to the first aspect of the invention to the floating platform via one of the mooring connection points; and anchoring the at least one rotatable buoyant marine transducer via the other of the mooring connection points.

Preferably, the method comprises the steps of temporarily securing the body in an orientation in which the body is rotated out of equilibrium prior to securing to the floating platform; securing the body to the floating platform under a low line tension; and releasing the body from the out of equilibrium orientation.

Preferably, the body of each of the one or more rotatable buoyant marine transducers comprises a ballast tank defining a weighted portion of the body and a buoyancy tank defining a buoyant portion of the body, the method comprising the steps of locating the one or more rotatable buoyant marine transducer in a body of water at or adjacent a deployment site in an un-ballasted state and with the buoyancy tank at least partially filled with air or water; anchoring the at least one rotatable buoyant marine transducer via one of the mooring connection points; securing the one or more rotatable buoyant marine transducer to the floating platform via the other of the mooring connection points; displacing ballast into the ballast tank; and displacing water out or air into the buoyancy tank.

Preferably, the body of each of the one or more rotatable buoyant marine transducers is secured such that a mooring line extending between an anchor and the body and a mooring line extending between the body and the floating platform each extend substantially vertically.

Preferably, the method comprises the step of tuning a stiffness curve of the at least one rotatable buoyant marine transducer such that as the body of the rotatable buoyant marine transducer rotates in response to tidal range variation the line tension between the rotatable buoyant marine transducer and the floating platform remains substantially constant.

As used herein, the term "transducer" is intended to mean a device capable of converting one form of energy, force or motion into another, for example linear motion into rotary motion or physical displacement into electrical energy, kinetic energy into potential energy, and/or work (force multiplied by distance) into rotational kinetic energy.

As used herein, the term "buoyant" is intended to mean neutrally buoyant, negatively buoyant, or positively buoyant.

BRIEF DESCRIPTION OF THE DRAWINGS

The present invention will now be described with reference to the accompanying drawings, in which:

FIG. 9(*b*) illustrates the load reduction device of FIG. 9(*a*) in a loaded state and having undergone rotational displacement;

DETAILED DESCRIPTION OF THE DRAWINGS

Figure 1:
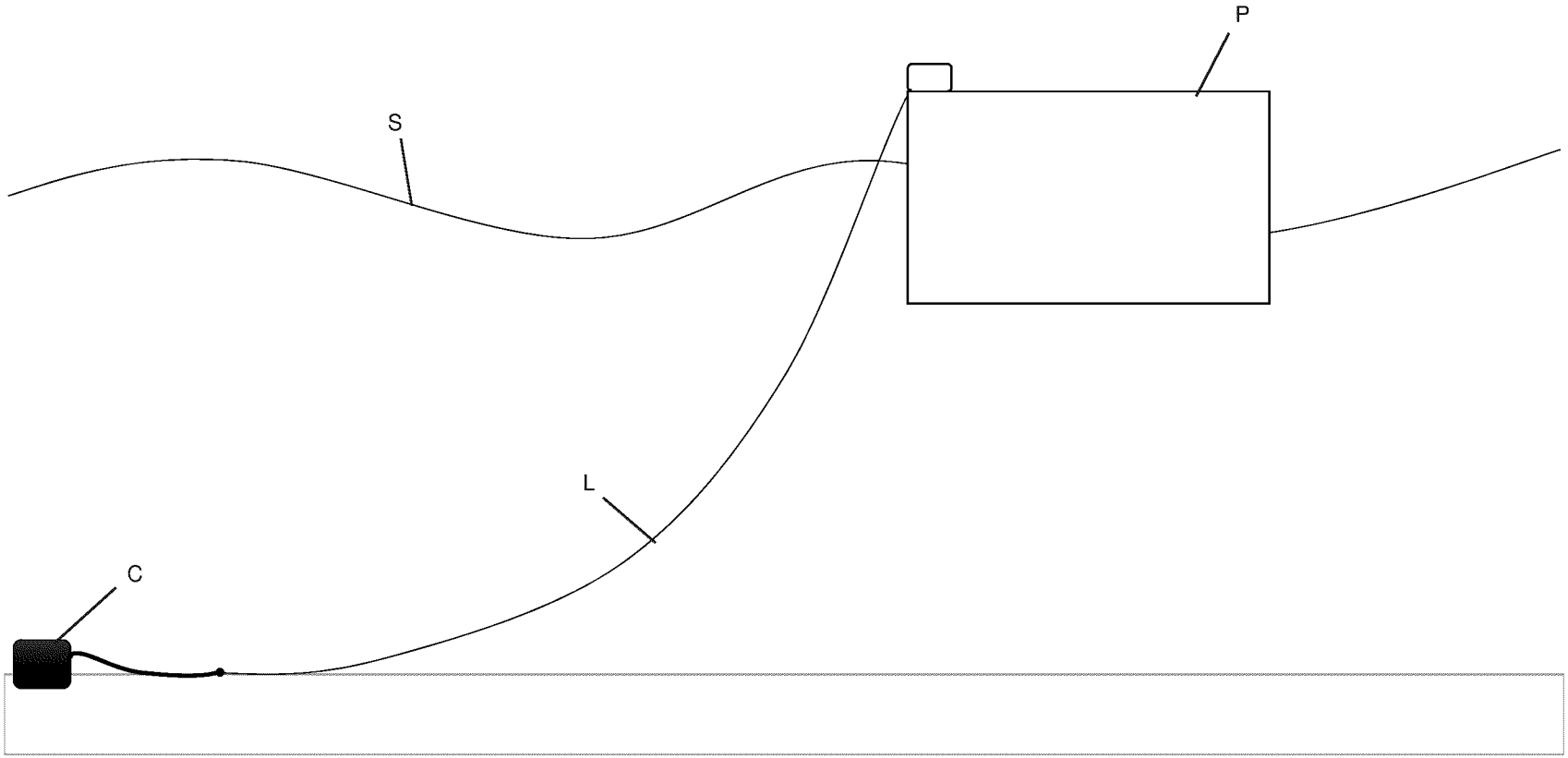
FIG. 1 illustrates a schematic representation of an existing mooring arrangement for a floating marine structure, with no significant environmental loading applied and a slack mooring line.
Figure 2:
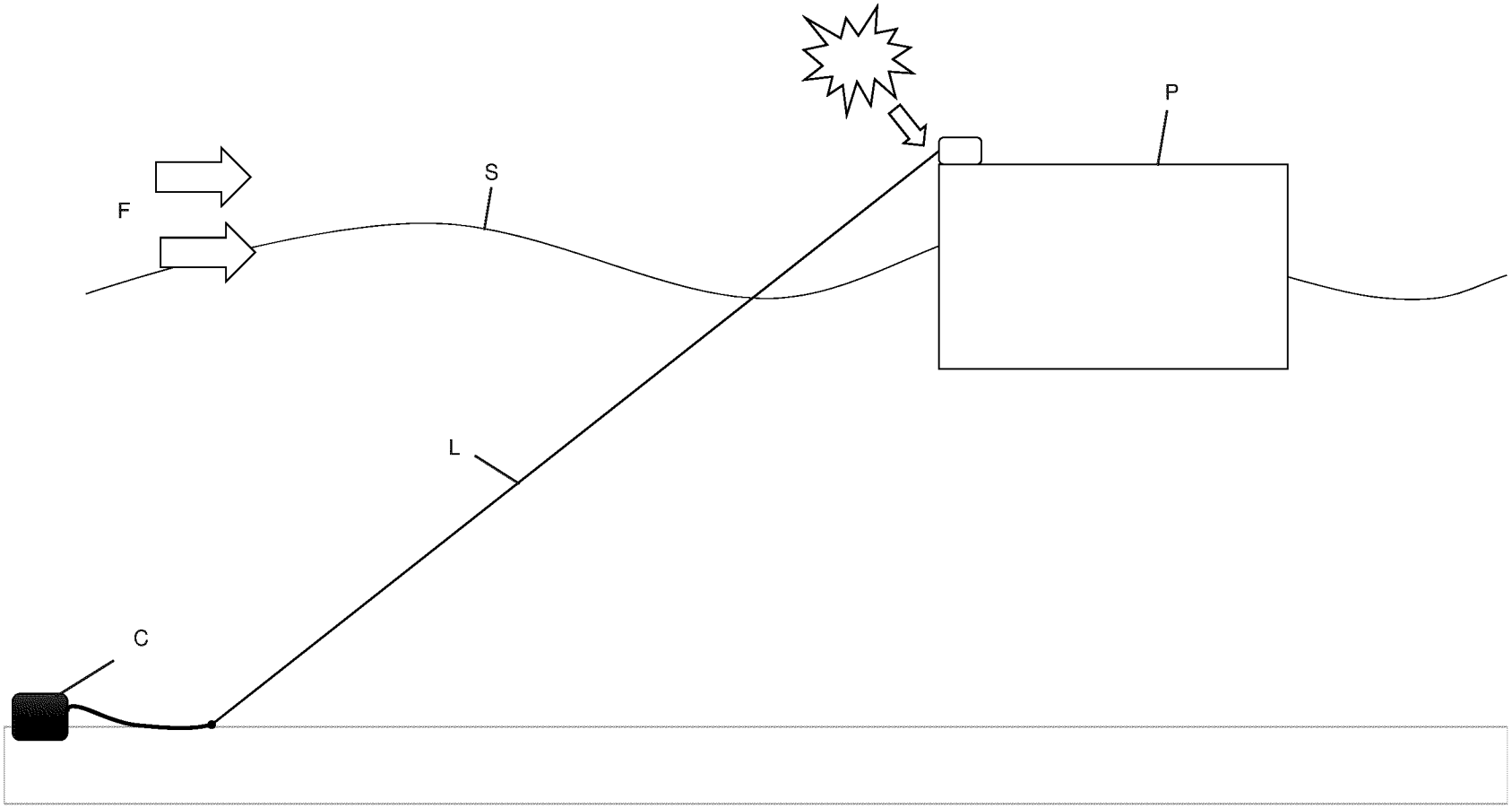
FIG. 2 illustrates the existing mooring arrangement of FIG. 1 with a load applied as a result of environmental forces acting on the system resulting in a taut mooring line.

FIGS. 1 and 2 illustrate a conventional mooring or station keeping system for securing a floating platform P on the surface of a body of water S, the conventional mooring system comprising a single or multiple mooring lines L secured between the platform P and an anchor C located on the seabed or other support surface. FIG. 1 shows the conventional mooring system in a relatively unloaded state and thus in the absence of significant environmental forces such as waves, wind or tide, and as a result the one (or more) mooring line L is relatively slack and the platform P is experiencing only baseline loading through the mooring line L.

FIG. 2 illustrates the conventional mooring system when environmental forces F are acting on the platform P such as to displace the platform P, thereby resulting in a taut mooring line L restraining or limiting movement of the platform P. Due to the type of undulating displacement that is induced by wind, wave and other environmental forces, significant shock loading is applied to the platform P via the mooring line L as it goes between slack and taut states. This cyclic loading is particularly harsh on the associated components, and the present invention has thus been developed with a view to providing an improved alternative to such conventional mooring systems.

Figure 3:
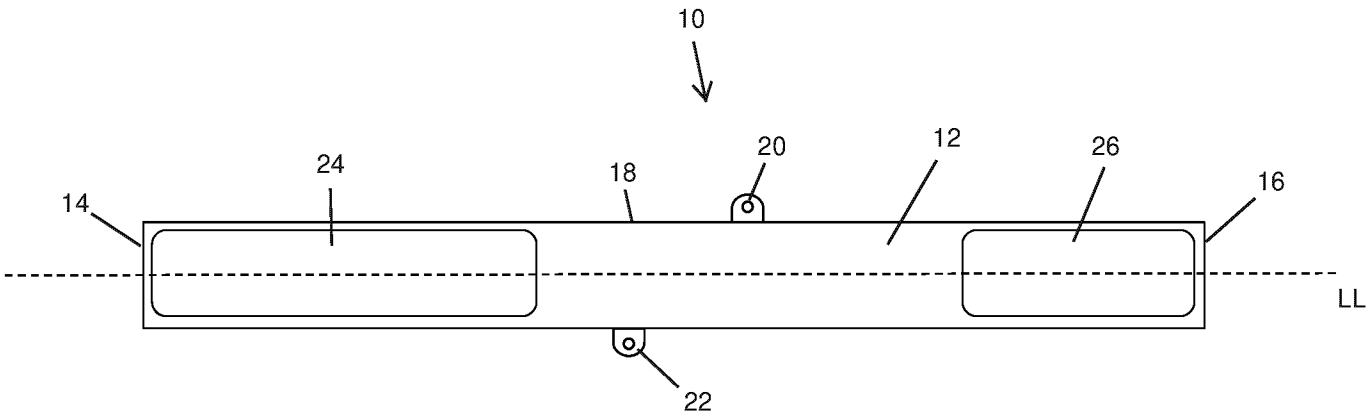
FIG. 3 illustrates a schematic representation of a rotatable buoyant marine transducer defining a load reduction device according to an aspect of the present invention for use in a load reduction system.

Turning then to FIG. 3 there is illustrated a rotatable buoyant marine transducer according to the present invention, defining a load reduction device according to an embodiment of the invention and generally indicated as 10, for use in securing a floating platform P on a body of water S in order to resist displacement of the platform P induced by external environmental forces and preferably to eliminate or attenuate the above mentioned shock, peak, snatch and/or fatigue loading which occurs when using a conventional mooring. The transducer in the form of the load reduction device 10 is therefore operable to convert at least a portion of the substantially linear loads or forces applied to the platform P via the external environmental forces into a force couple biased rotation of the load reduction device 10. In this way, and as explained in greater detail below, the load reduction device converts linear motion into rotary motion in order to dissipate the forces acting on the platform P.

The load reduction device 10 of the invention comprises a body 12 which in the embodiment illustrated is of elongated cylindrical form, and whose shape and dimensions may vary depending on the particular application, in particular the size and/or weight of the platform P to be secured and/or the prevailing local environmental conditions. As an exemplary embodiment, the body 12 has a length in a longitudinal direction as defined by a longitudinal axis LL of 20 m and a diameter of 2 m. The body 12 may be formed from any suitable material, for example steel, composite, plastic, concrete or any other suitable material or combination of material and which are capable of withstanding the local environmental conditions over prolonged periods of time. The body 12 defines a first end 14 and a second end 16 extending between which is a cylindrical side wall 18. Provided on the side wall 18, preferably diametrically opposed but longitudinally separated or offset from one another, are a first mooring connection point 20 and a second mooring connection point 22. The first and second mooring connection points 20, 22 may be of any suitable form permitting a respective mooring line to be secured thereto as described hereinafter in detail.

The position of one or both of the mooring connection points 20, 22 may be longitudinally adjusted or adjustable along the sidewall 18, again as will be described in detail hereinafter, in order to alter the separation or offset between the mooring connection points 20, 22, and which thus has a bearing on the stiffness response curve established by the body 12 in resisting and attenuating the loading applied to the body 12, as detailed hereinafter. It is to be understood that the mooring connection points 20, 22 may be located internally of the sidewall of the body, or outboard thereof, and this longitudinal adjustability is intended to also apply to such configurations. Similarly the radial or transverse position of one or both of the mooring connection points 20, 22 may be adjusted or adjustable in order to further alter the stiffness response curve of the load reduction device 10, in particular by altering the angle defined between the respective mooring connection point 20, 22 and a centre of gravity (COG) and/or centre of buoyancy (COB) of the body 12.

The load reduction device 10 is adapted to be located in the body of water S and when at rest or unloaded to assume a first orientation in which the longitudinal axis LL is in a nominal orientation, which in this first embodiment is substantially vertically disposed. This may be achieved by any suitable means, but in the preferred embodiment illustrated the body 12 defines a first portion 24 extending from the first end 14 and which is buoyant, preferably by the provision of a quantity of buoyant material such as air or foam within the body 12, and a second portion 26 extending from the second end 16 and longitudinally spaced from the first portion 24 and being weighted, preferably by the provision of one or more weights disposed internally of the body 12. It is also preferred that the buoyancy and weight respectively of the first portion 24 and second portion 26 may be adjusted, for example by the addition or subtraction of buoyant and weighted material thereto. In particular the weighted material or ballast may be added only once the device 10 has been deployed, in order to ease transport and installation.

Figure 4:
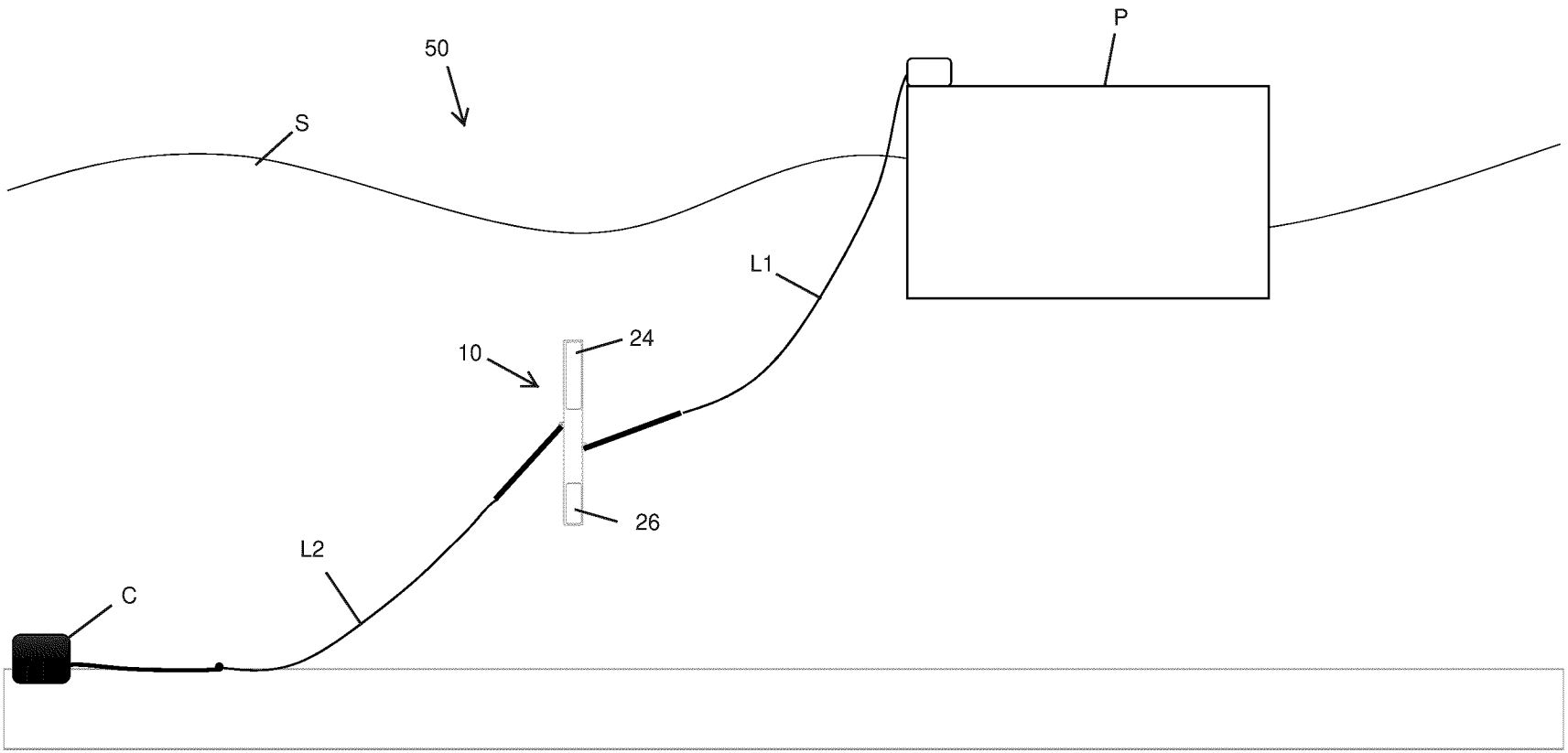
FIG. 4 illustrates the load reduction device of FIG. 3 provided as part of a load reduction system securing a floating marine platform and with no significant environmental loading applied and slack mooring lines.

By providing the first portion 24 and second portion 26 longitudinally separated from one another, and preferably adjacent the first end 14 and second end 16 respectively, the body 12 will tend towards the first vertical orientation when located in the body of water S, for example as illustrated in FIG. 4, which also illustrates both mooring lines L1, L2 having an optional rigid section at the connection to the body 12. The ratio of weight to buoyancy of the body 12 will dictate whether the load reduction device 10 is neutrally buoyant, negatively buoyant, or positively buoyant. In the embodiment illustrated in FIG. 4 the load reduction device 10 is neutrally buoyant and therefore tends to rest in an upright position below the surface of the water S.

The load reduction device 10 is intended to form part of a load reduction system 50 comprising at least one of the load reduction devices 10, a first mooring line L1 secured between the floating platform P and the body 12 via the first mooring connection point 20, and a second mooring line L2 secured between the body 12 and a anchor C via the second mooring connection point 22. It will of course be appreciated that the anchor C may be replaced with any other suitable functional alternative.

Figure 5:
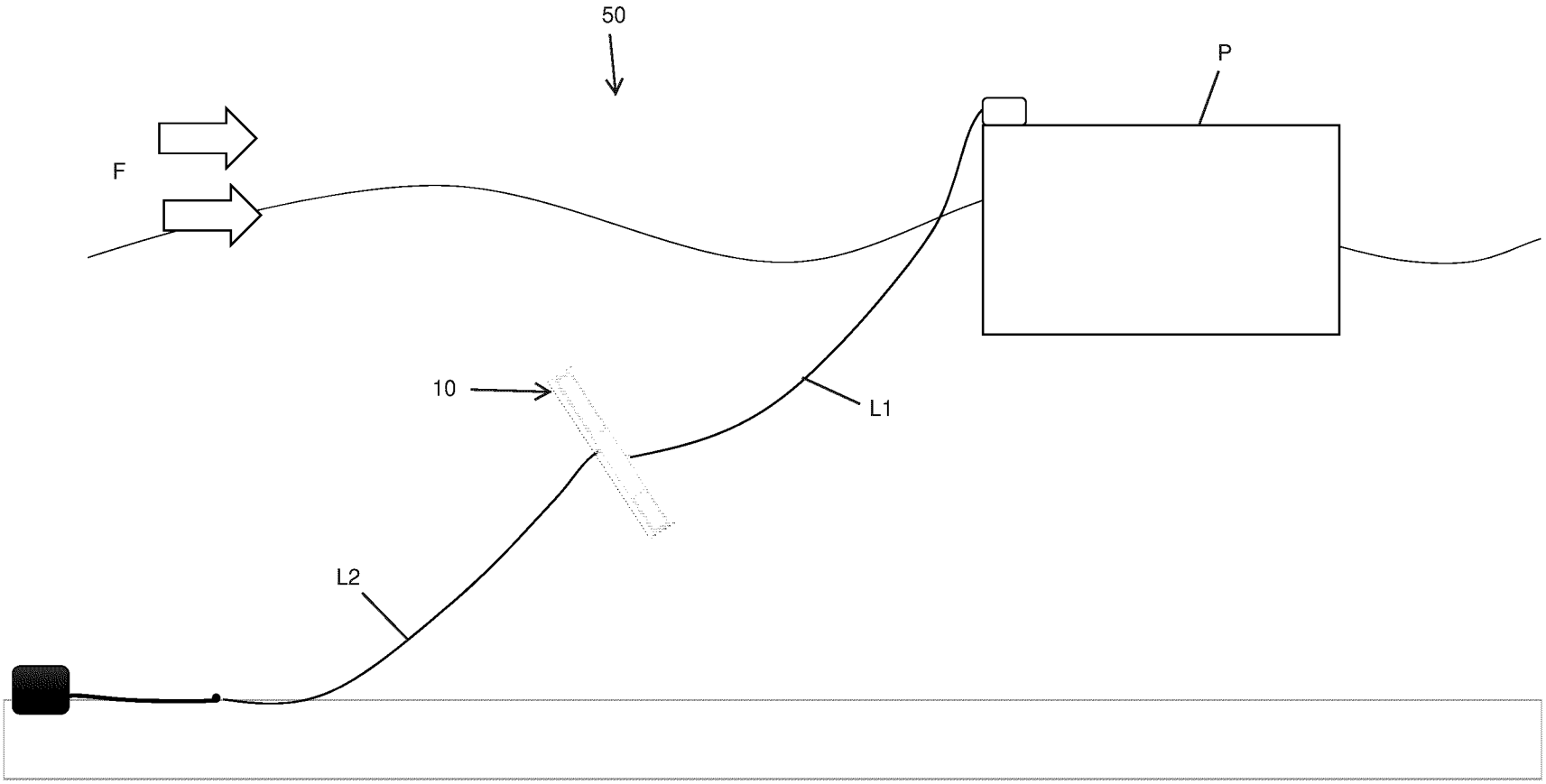
FIG. 5 illustrates the arrangement of FIG. 4 with the load reduction device in a loaded state and having undergone rotational displacement.

Turning then to FIG. 5, when a load is applied to the load reduction device 10 in response to environmental forces acting to displace the platform P, the first and second mooring lines L1, L2 will be tensioned while the body 12 initially remains in a substantially vertical orientation. Then as a result of the longitudinal offset between the first and second mooring connection points 20, 22, the tension established by the opposing and offset forces acting on opposite sides of the body 12 effectively applies an overturning moment to the body 12 which will act to rotate the body 12 about a horizontally extending axis of rotation located, for example, between the first and second mooring connection points 20, 22. It will however be understood that this axis of rotation may be located not only between the mooring connection points. Due to translation of body 12 within the mooring spread the body 12 can rotate about a different axis outside of the mooring connection points. In a semi-taut or catenary mooring the body 12 will translate when the load reduction device 10 becomes loaded and is rotated towards a horizontal orientation, and so motion of the load reduction device 10 is rotational due to the torque couple but there is also a global translation of the device 10. As a result of the two movements there may be a net rotation about a virtual pivot outside of the device geometry.

The environmental forces acting to rotate the body 12 via the tension applied through the mooring lines L1, L2 will be countered by a force couple generated by the buoyant first portion 24 and the weighted second portion 26 which together create a self righting moment on the body 12. This self righting or restoring moment tends to displace the body 12 back towards the vertical position, thereby acting to resist the forces generated by the environmental conditions displacing the floating platform P.

Figure 6:
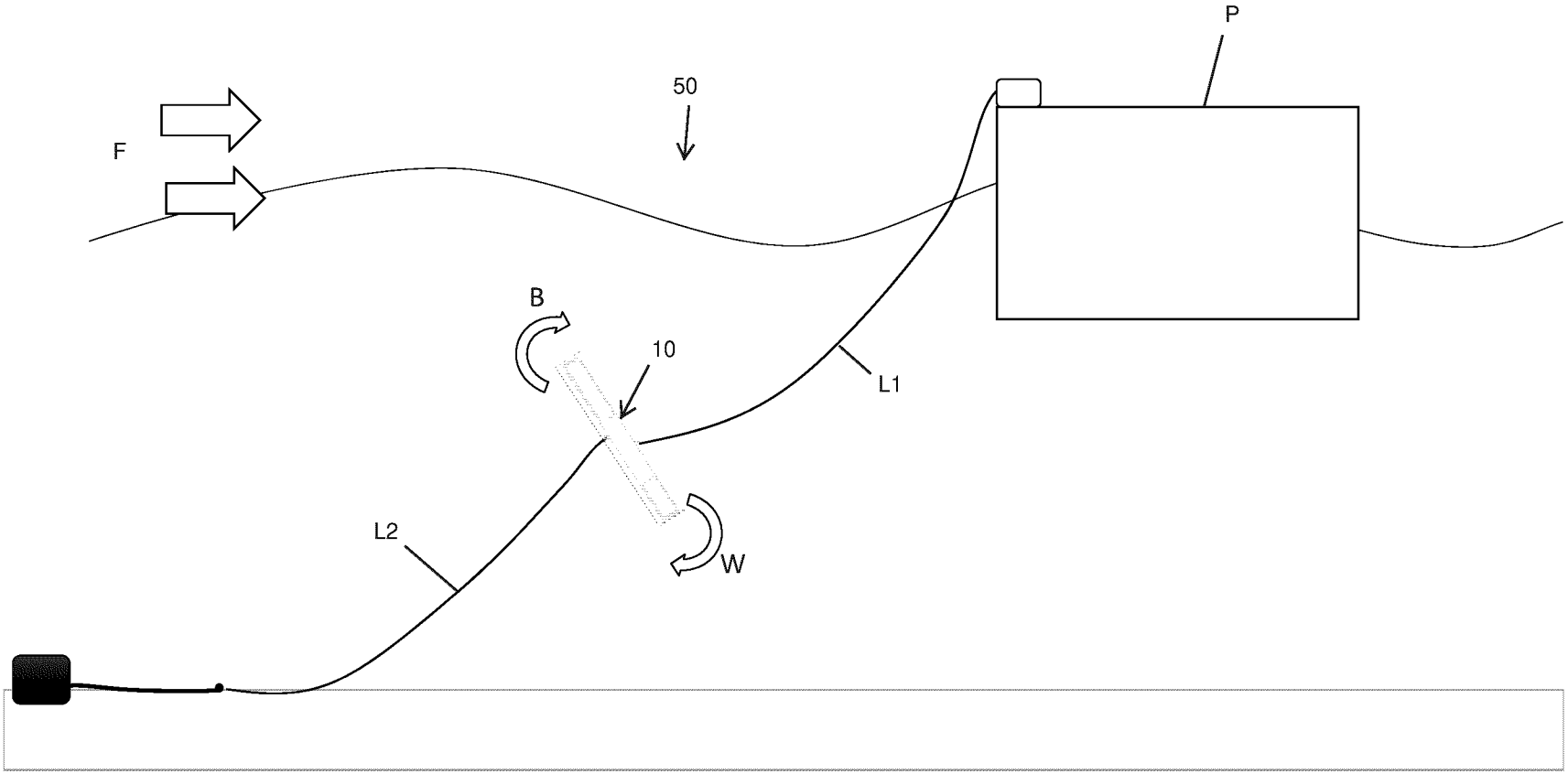
FIG. 6 illustrates the arrangement of FIG. 5 and including a pair of arrows illustrating a restoring force couple generated by the load reduction device of the invention.
Figure 7:
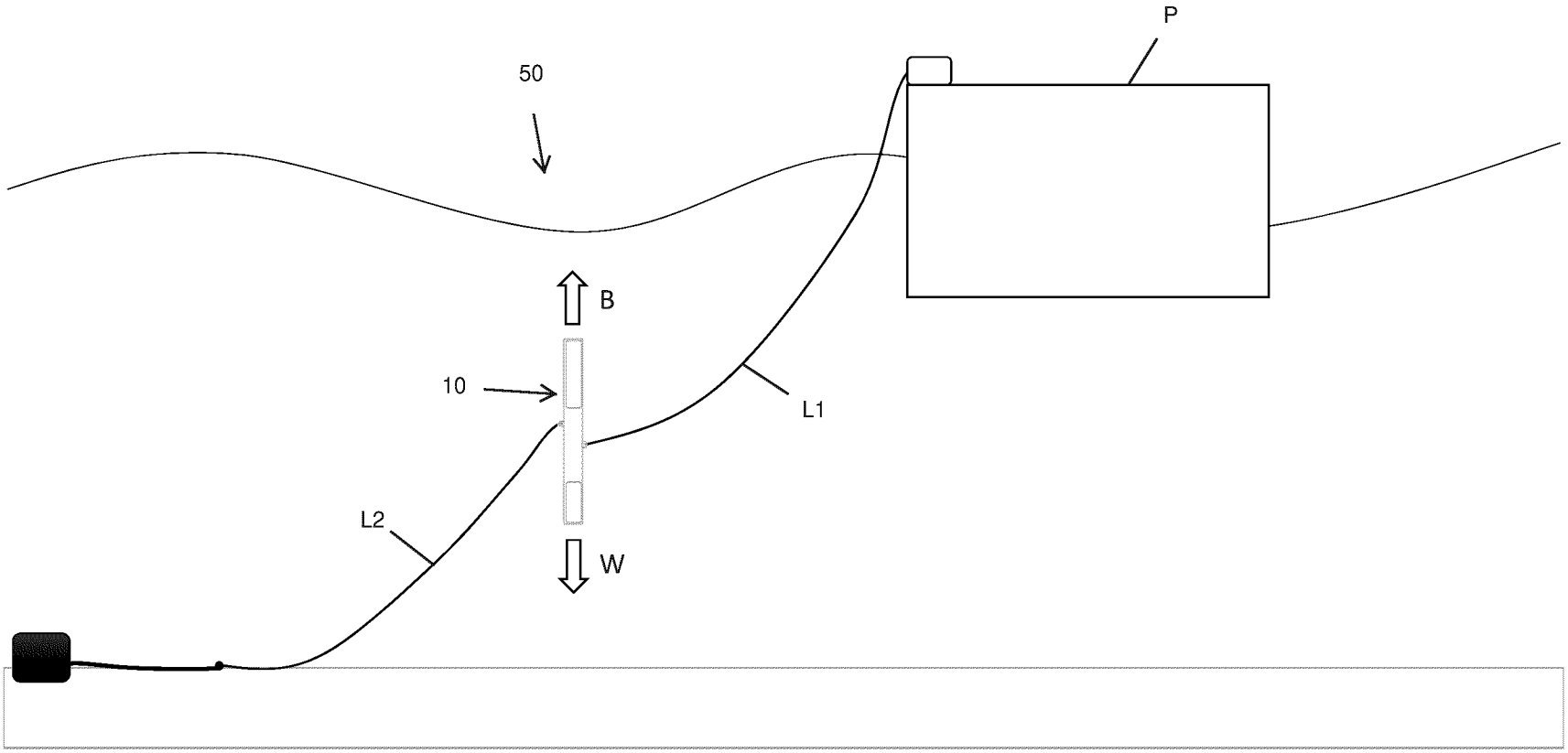
FIG. 7 illustrates the load reduction system as shown in FIGS. 4-6 and having been restored to an upright or unloaded orientation.

The load reduction device 10 and related load reduction system 50 therefore act to maintain the position of the floating platform P within an allowable excursion area and to attenuate shock loading that might otherwise be applied to the platform P when the environmental forces displace the platform P. FIG. 6 schematically illustrates the force couple generating the restoring moment on the body 12, namely the buoyant force B acting to rotate the first end 14 upwardly and the weight based force W acting to rotate the second end 16 downwardly. FIG. 7 illustrates the load reduction system 50 having returned to the first unloaded orientation in which the body 12 is disposed with the longitudinal axis LL substantially vertically oriented and keeping the platform P in the intended location.

In order to augment the above mentioned functionality the body 12 may be shaped or otherwise modified to generate maximum drag when the body 12 is being displaced in one direction, namely from the vertical towards or beyond the horizontal orientation under the influence of the environmental forces, and to generate minimum drag when being displaced in the opposite direction, namely back towards the vertical position. In this way the drag provides an additional resistance to the environmental forces.

Figure 8:
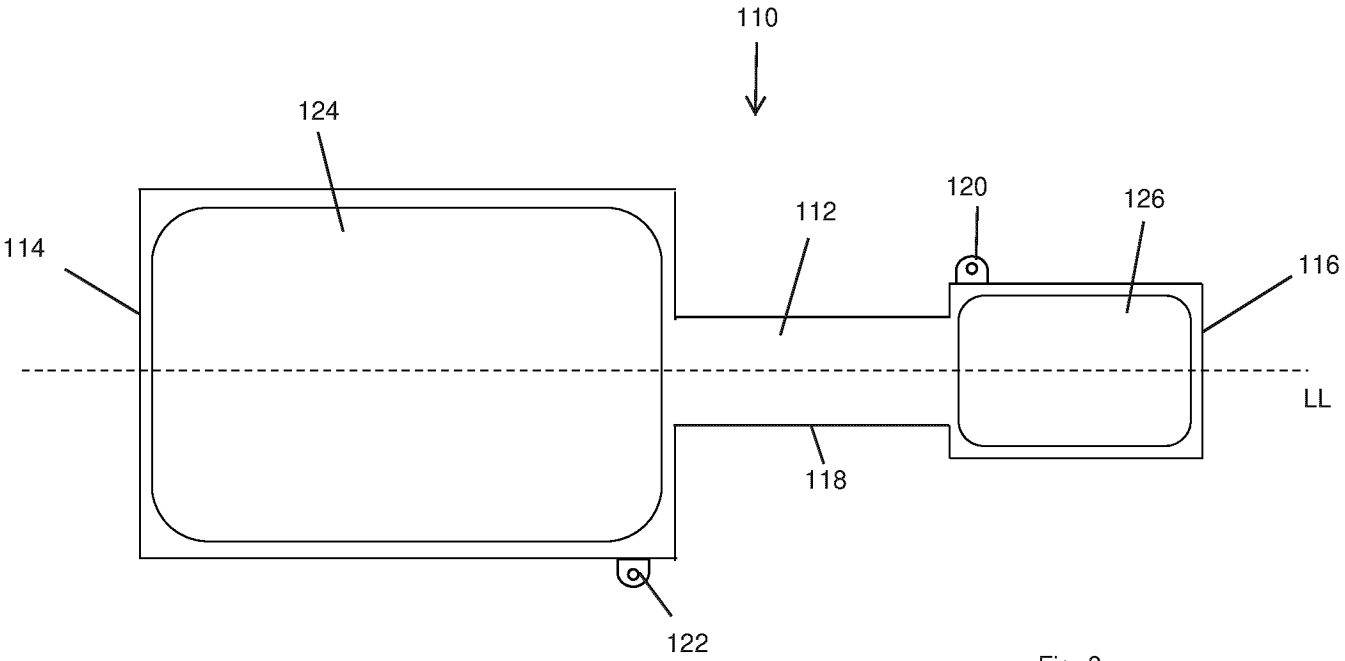
FIG. 8 illustrates a schematic representation of a load reduction device according to an alternative embodiment of the present invention.

Referring now to FIGS. 8 and 9 there is illustrated a second embodiment of a load reduction device according to the present invention, generally indicated as 110. In the second embodiment like components have been accorded like reference numerals and unless otherwise stated perform a like function. The load reduction device 110 comprises a cylindrical body 112 having a first end 114 and an opposed second end 116, extending between which is a sidewall 118. The body 112 comprises a first portion 124 extending from the first end 114 and containing a buoyant material therein such as foam or air, and a second portion 126 extending from the second end 116 and containing a weight or ballast therein, in order to provide the functionality as described above with reference to the first embodiment. Unlike the first embodiment the body 112, while being cylindrical, is of stepped diameter with the first portion 124 having a significantly larger diameter than the second portion 126, both ends having a larger diameter than the intermediate or connecting section of sidewall 118.

In the second embodiment the first mooring connection point 120 is provided on the second portion 126 and the second mooring connection point 122 is provided on the first portion 124. As with the first embodiment the mooring connection points 120, 122 are preferably diametrically opposed but longitudinally spaced for offset relative to one another. While the mooring connection points 120, 122 are disposed on the sidewall 118 of the second portion 126 and the first portion 124 respectively, it will be appreciated that they may be moved individually or together onto the intermediate section of sidewall 118 connecting the first and second portions 124, 126, or to any other suitable location about the body 112.

Figure 9B:
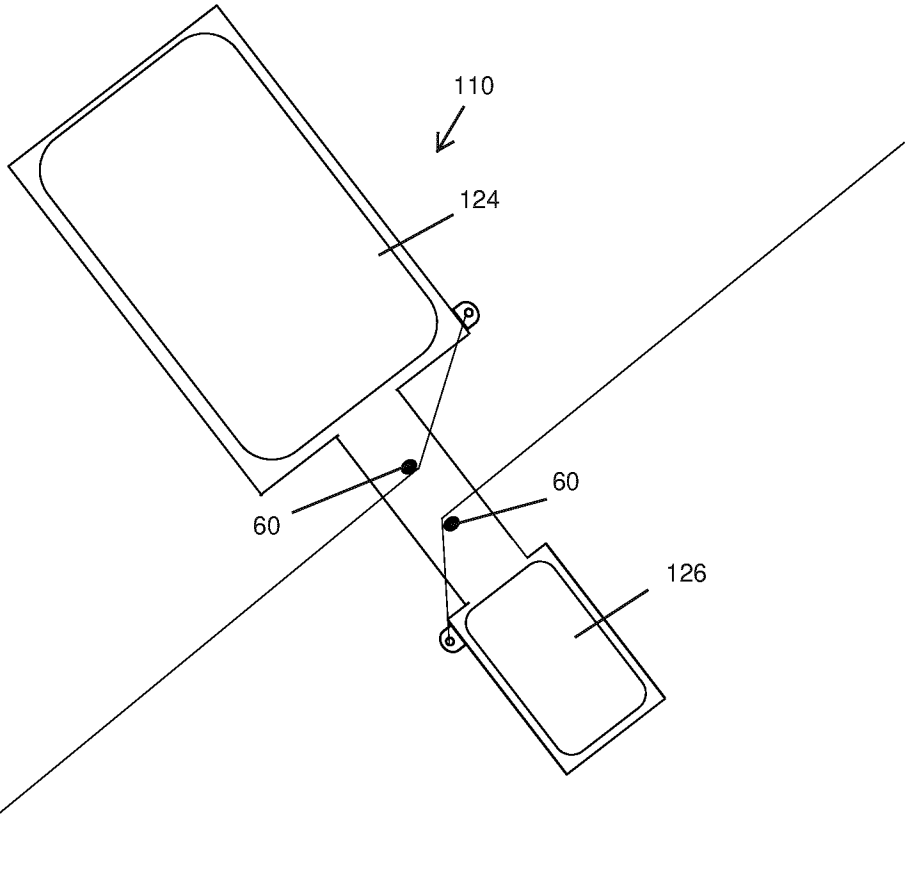
FIG. 9(*a*) illustrates the load reduction device of FIG. 8 in use and having a pair of mooring lines secured thereto, but in an unloaded state and orientation.
Figure 9A:
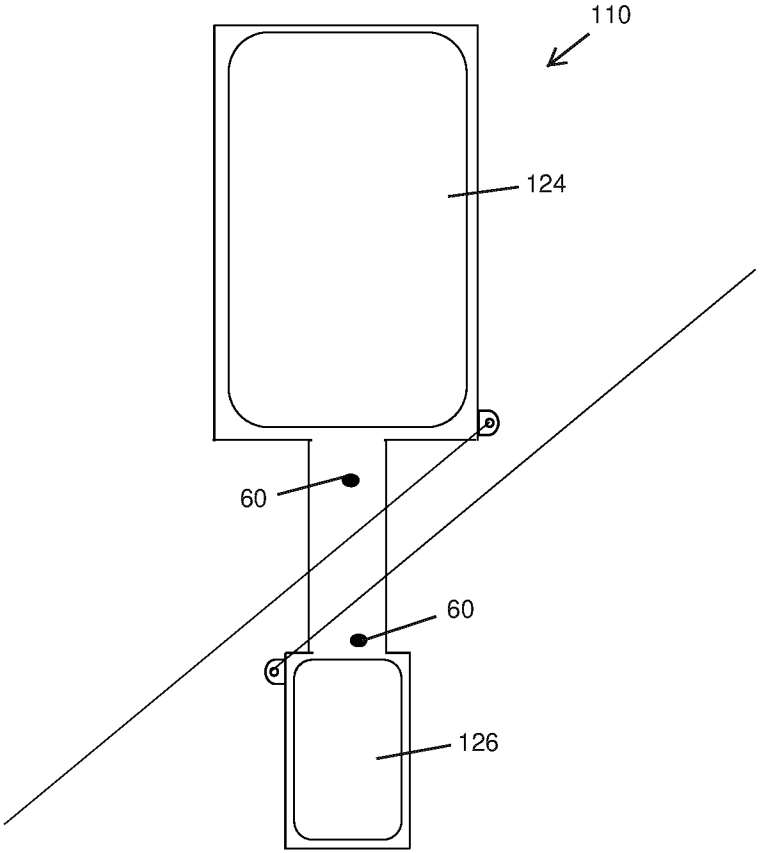

FIG. 9*a* illustrates the load reduction device 110 having first and second mooring lines L1, L2 secured thereto via the first and second mooring connection points 120, 122, as hereinbefore described. FIG. 9*a* illustrates the load reduction device 110 in an unloaded and thus vertical orientation while FIG. 9*b* shows the load reduction device 110 in a loaded and rotated orientation. Unlike the first embodiment the mooring lines L1, L2 cross over the body 112 such that each connection point is offset at the far side of the body 112 from the respective mooring line, which arrangement is significant in controlling the stiffness response. The device 110 as illustrated in FIGS. 9*a* and 9*b* has also been modified over the device 110 of FIG. 8 by the provision of one or more fairleads 60 extending outwardly from the sidewall 118 in order to alter the point at which the load from each of the mooring lines L1, L2 acts on the body 112 when undergoing rotation, thereby varying the stiffness response of the load reduction device 110 relative to the applied environmental load. The fairleads 60 may be positioned such that contact is progressively made between the mooring line and fairlead(s) 60 as the device 10 rotates, or such that contact is progressively lost between the mooring lines and fairlead(s) 60 as the device 10 rotates.

Figure 10:
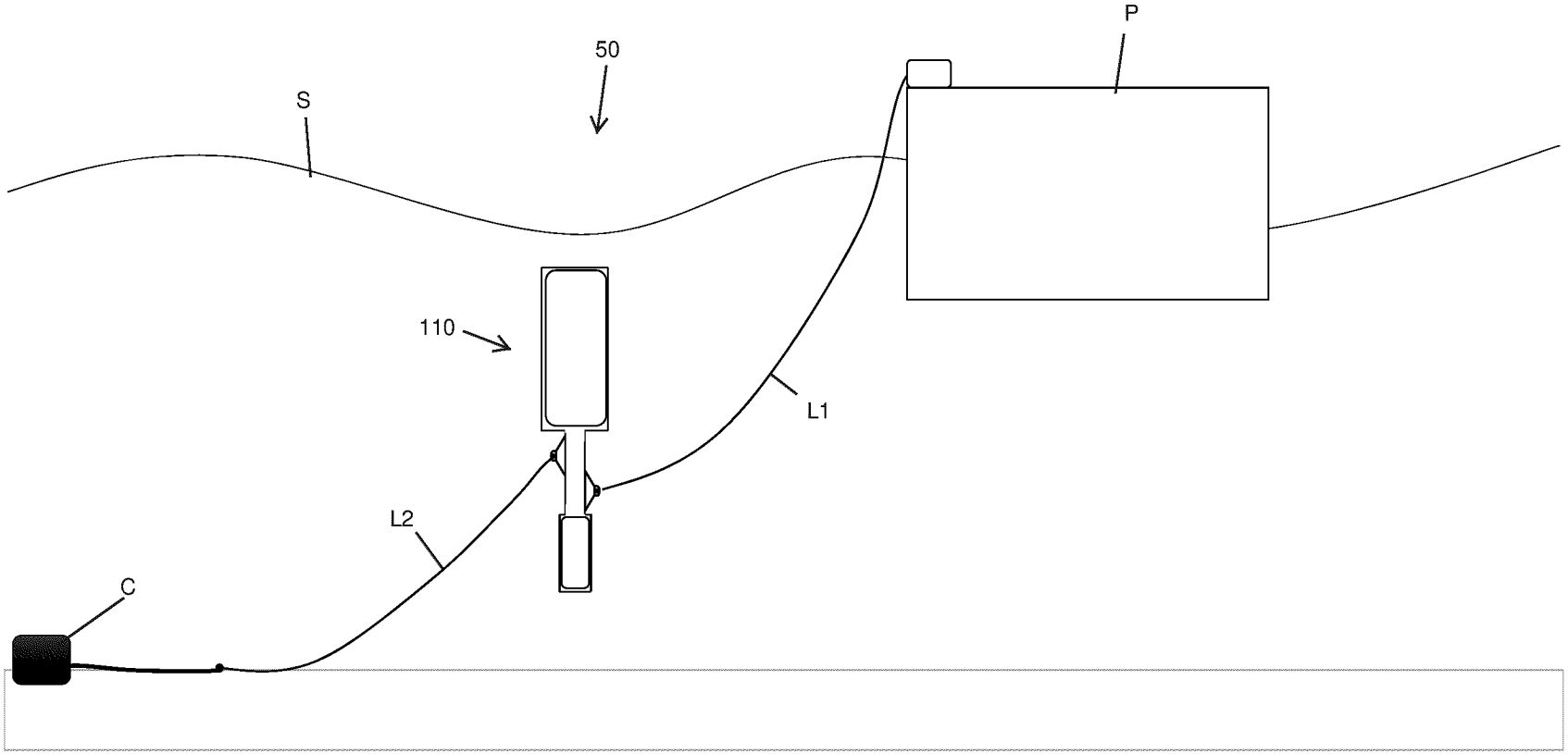
FIG. 10 illustrates the load reduction device shown in FIGS. 8 and 9 deployed as part of a load reduction system, the load reduction device having neutral buoyancy.
Figure 11:
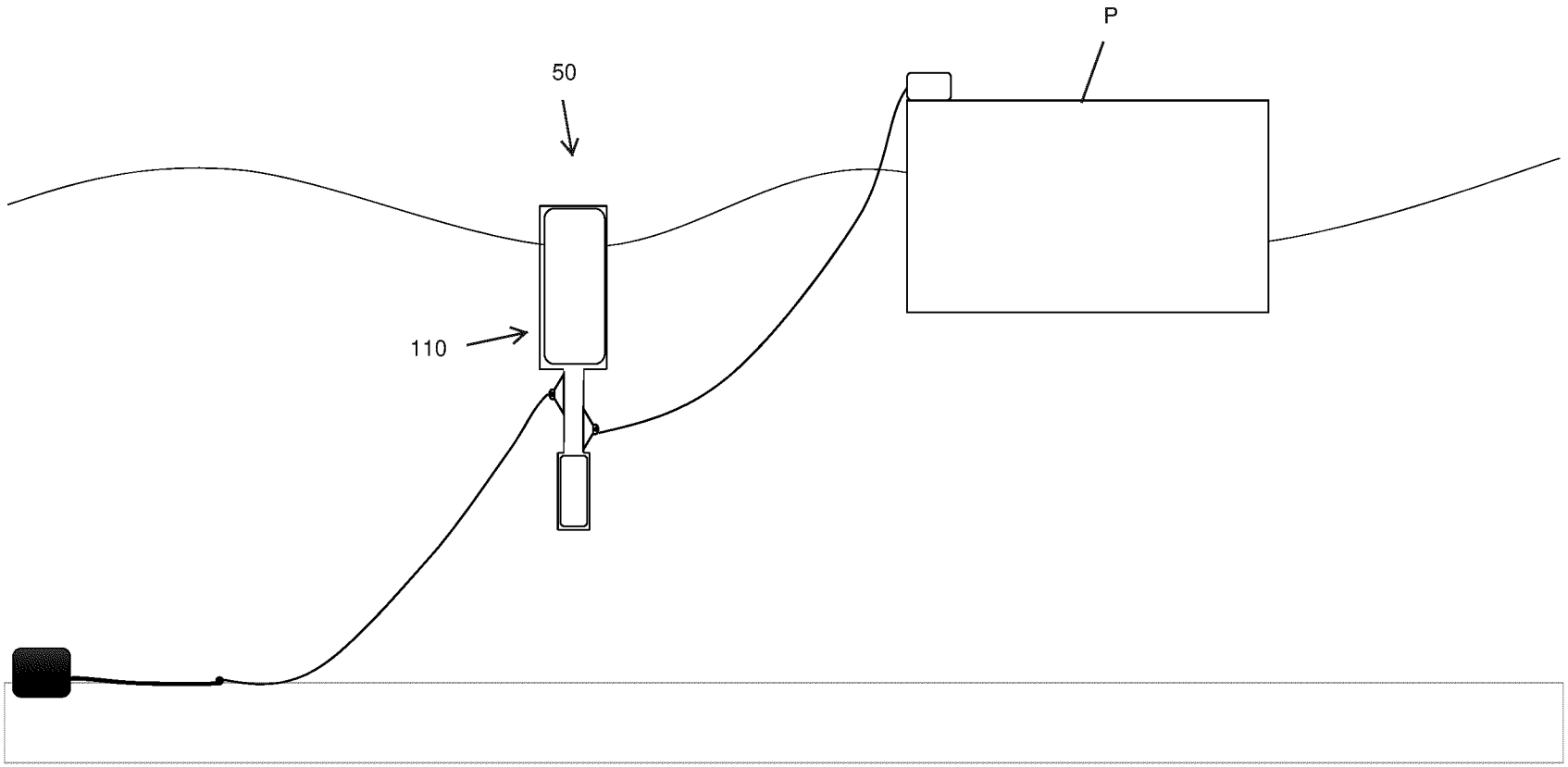
FIG. 11 illustrates the load reduction device of FIGS. 8 and 9 deployed as part of a load reduction system, but where the load reduction device is positively buoyant.

FIG. 10 illustrates the load reduction device 110 configured for neutral buoyancy, while FIG. 11 illustrates the load reduction device 110 configured for positive buoyancy in order to break the surface of the body of water S. The device 110 is modified from that shown in FIG. 8 by locating the mooring connection points radially outwardly of the sidewall of the body, again to further alter the stiffness response of the device 110.

Figure 12:
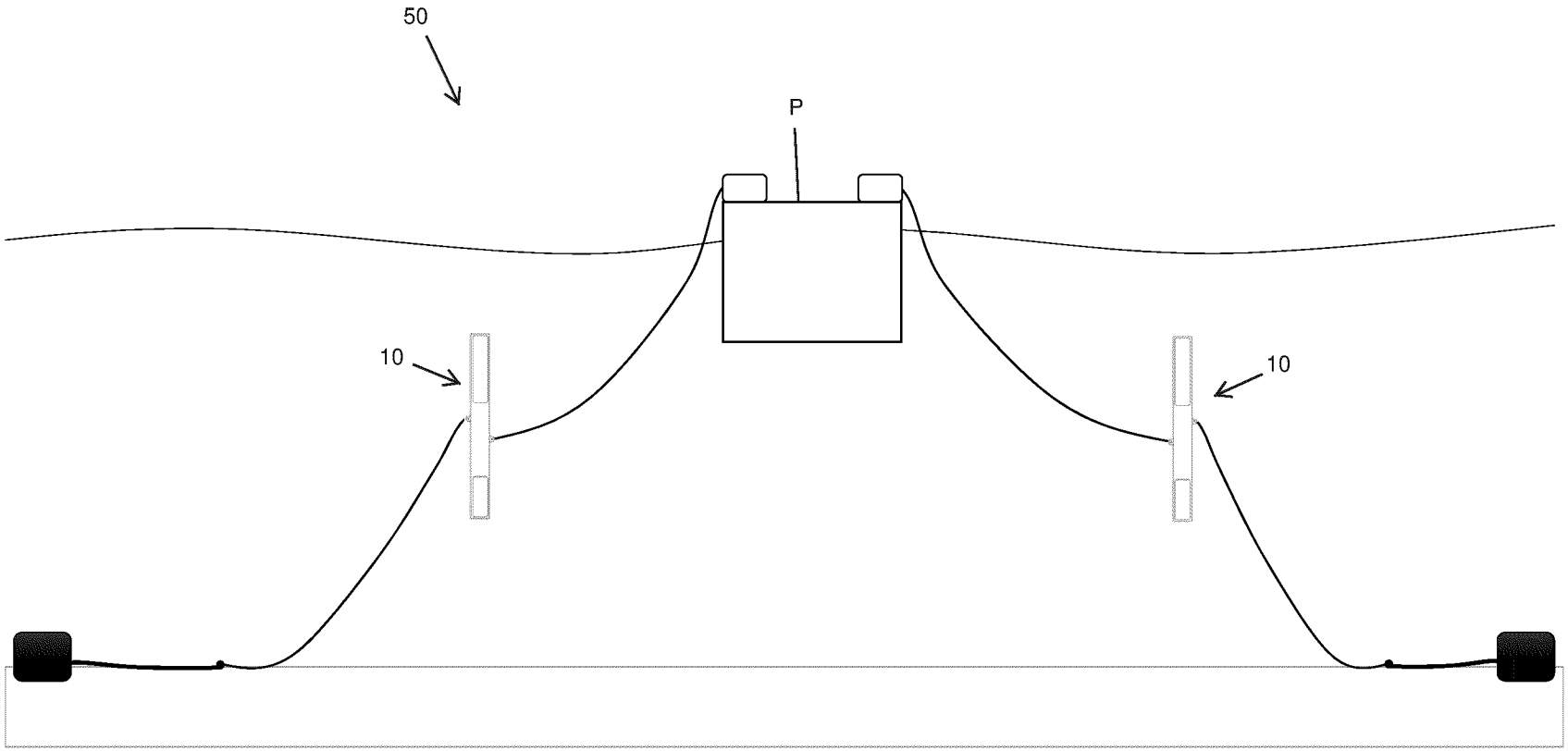
FIG. 12 illustrates a pair of load reduction devices deployed as part of a load reduction system to secure a floating marine platform.
Figure 13:
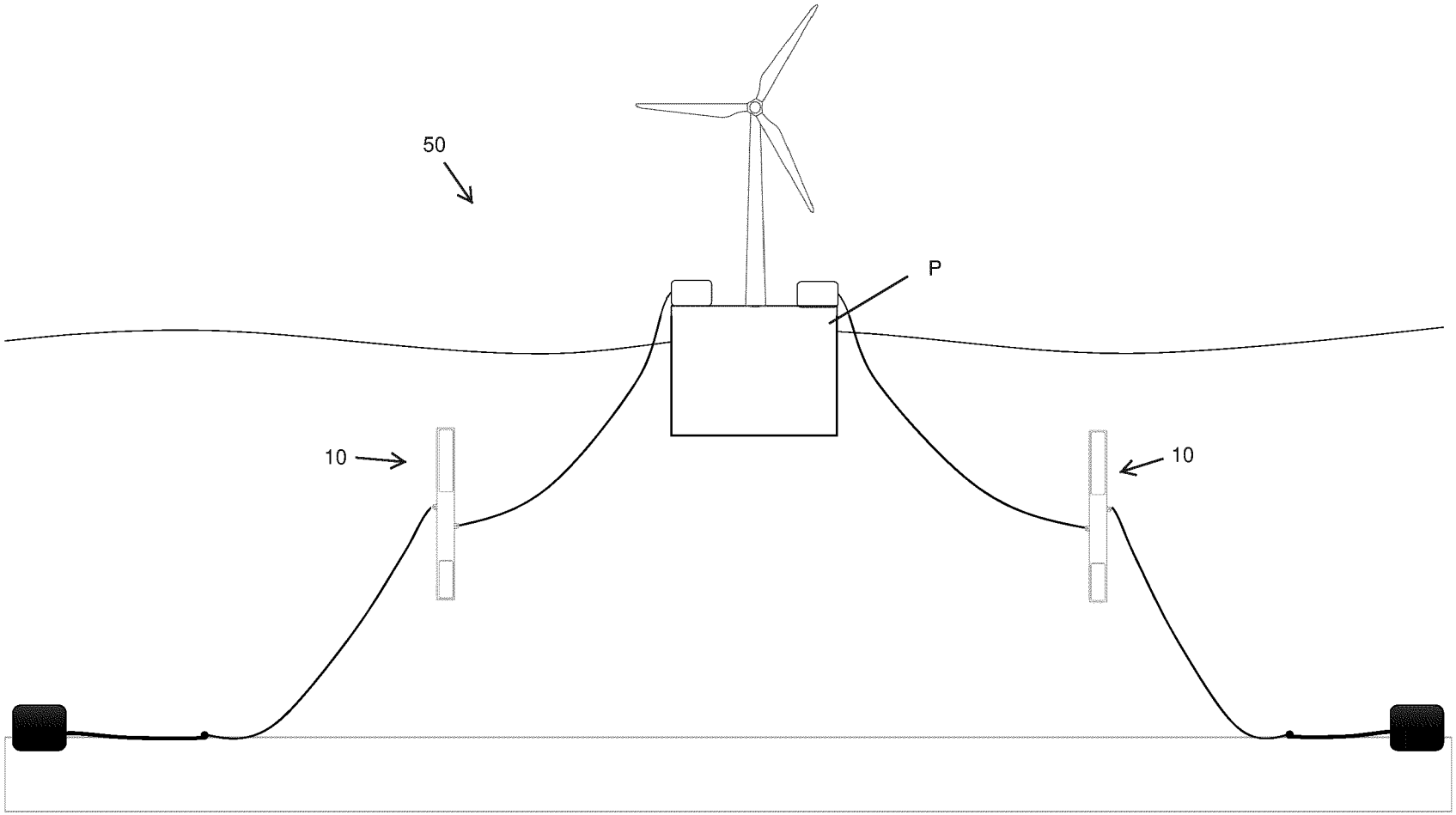
FIG. 13 illustrates the arrangement of FIG. 12 securing a floating wind turbine platform.
Figure 15:
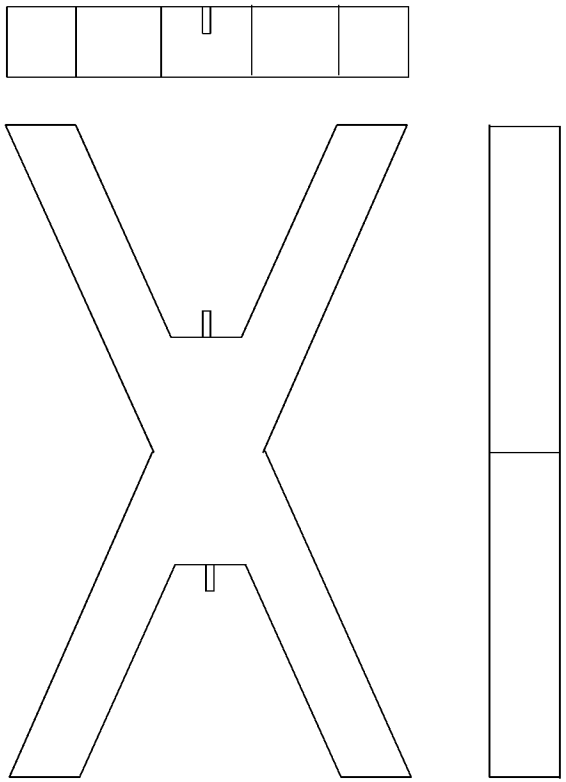
FIG. 15 illustrates a plan, elevation and end view of an alternative shape of load reduction device according to the present invention.

It will also be appreciated, for example as illustrated in FIGS. 12 and 13, that two or more of the load reduction devices 10; 110 may be provided in order to adequately secure the floating platform P, each connected to a respective anchor C. FIG. 13 illustrates a floating wind turbine platform P as one particular application for the load reduction device 10; 110. The load reduction device 10; 110 could also include two or more articulated sections (not shown), for example hingedly secured to one another, to further manipulate the stiffness response curve to be generated. In addition the shape of the body 12 could be varied significantly, and could for example be provided as a cross shaped member including two buoyant arms and two weighted arms, or any other suitable configuration, as shown for example in FIG. 15.

In any mooring system the tidal or other currents and wind loading, in addition to the mooring preload, result in a background or baseline tension on the mooring line or lines forming part of the mooring system. The baseline tension acting on a catenary or semitaut or taut mooring increases the stiffness response of the mooring system. As a result subsequent wave or wind gust loads act on a stiff mooring resulting in very high tensile forces.

The load reduction device 10; 110 of the invention preferably provides a non-linear stiffness response curve as the body 12; 112 undergoes the rotational or other displacement from the unloaded to loaded state, for example as illustrated in FIG. 14, in order to address the above mentioned issue. FIG. 14*a* illustrates the response curve where the first and second mooring connection points 20; 120, 22; 122 are longitudinally spaced or offset from one another by a set distance, for example 5m. The response curve may be varied by adjusting the offset or longitudinal separation between the first and second mooring connection points 20; 120, 22; 122, for example as illustrated in FIG. 14*c* in which the distance or offset between the mooring connection points 20; 120, 22; 122 is altered. FIG. 14*b* illustrates the effect of modifying the distance between the COB of the buoyant portion and the COG of the weighted portion. FIG. 14*d* illustrates the variation in stiffness response curve when the first and second mooring connection points 20, 120, 22 and 122 are adjusted or moved radially or transversely away from the longitudinal axis, outward or inward of the body 12, 112 such as to adjust the angle between the COB, first and second mooring connection points and the COG of the body 12, 112.

Figure 14A:
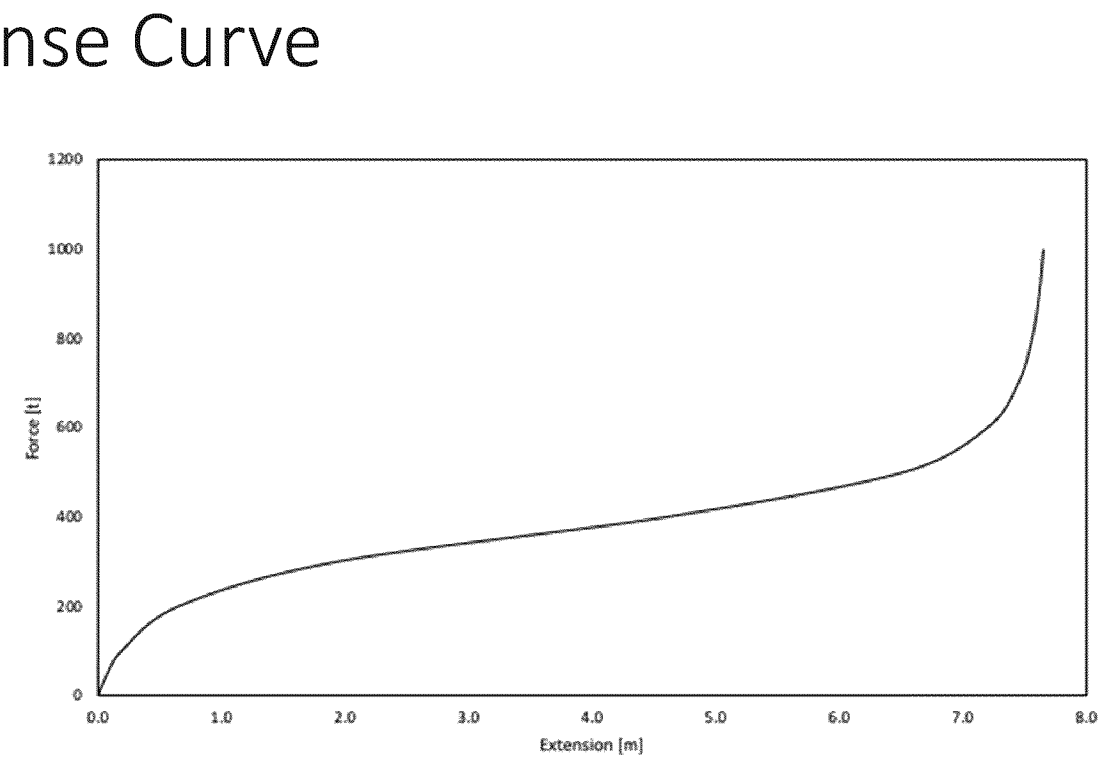
FIGS. 14*a* to 14*e* illustrate various stiffness response curves that may be achieved by varying physical characteristics of the load reduction device of the invention.
Figure 14B:
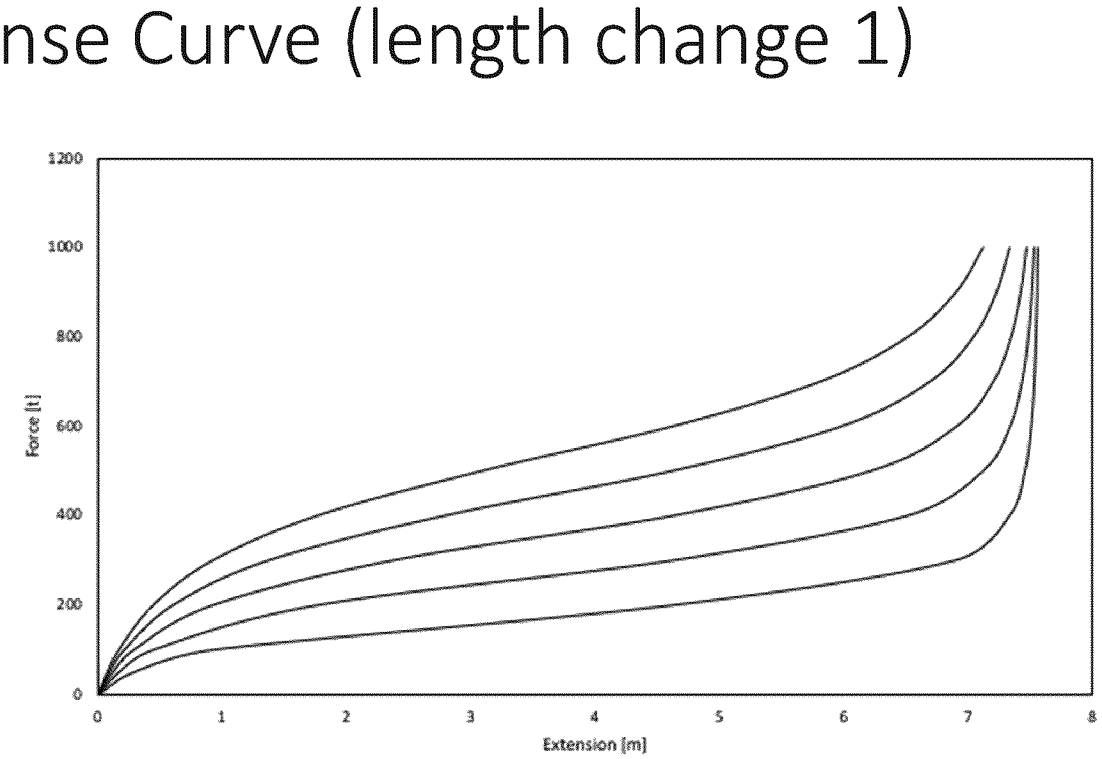
Figure 14C:
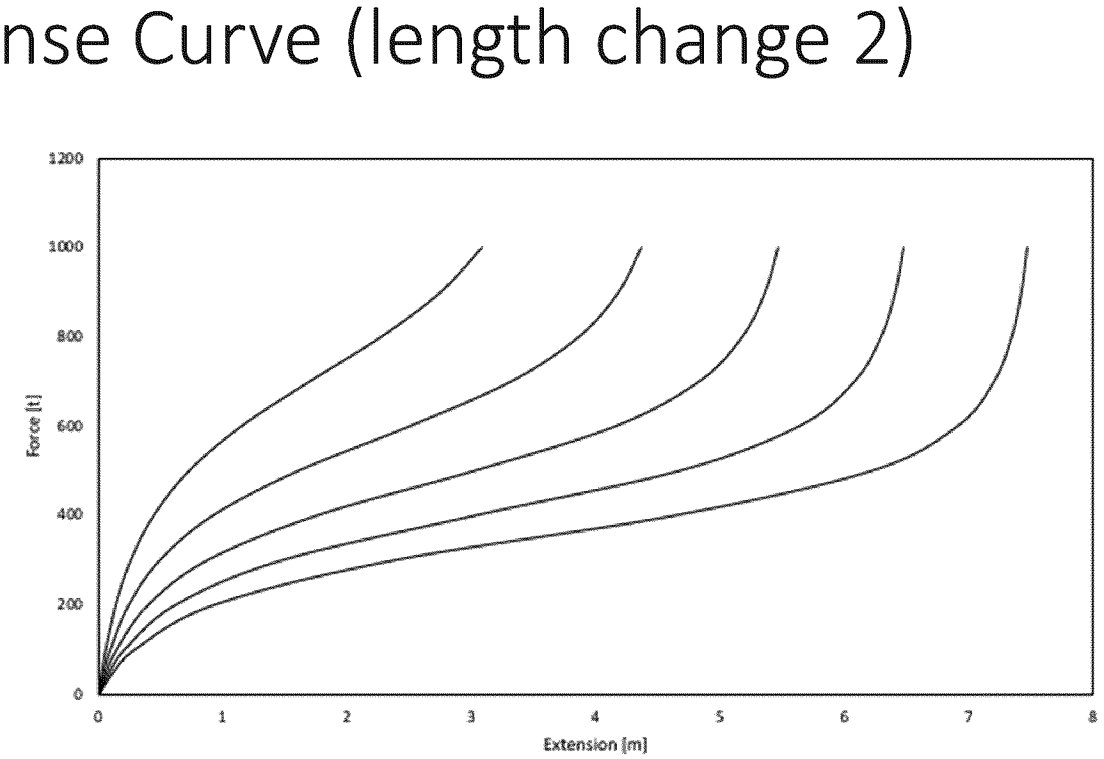
Figure 14D:
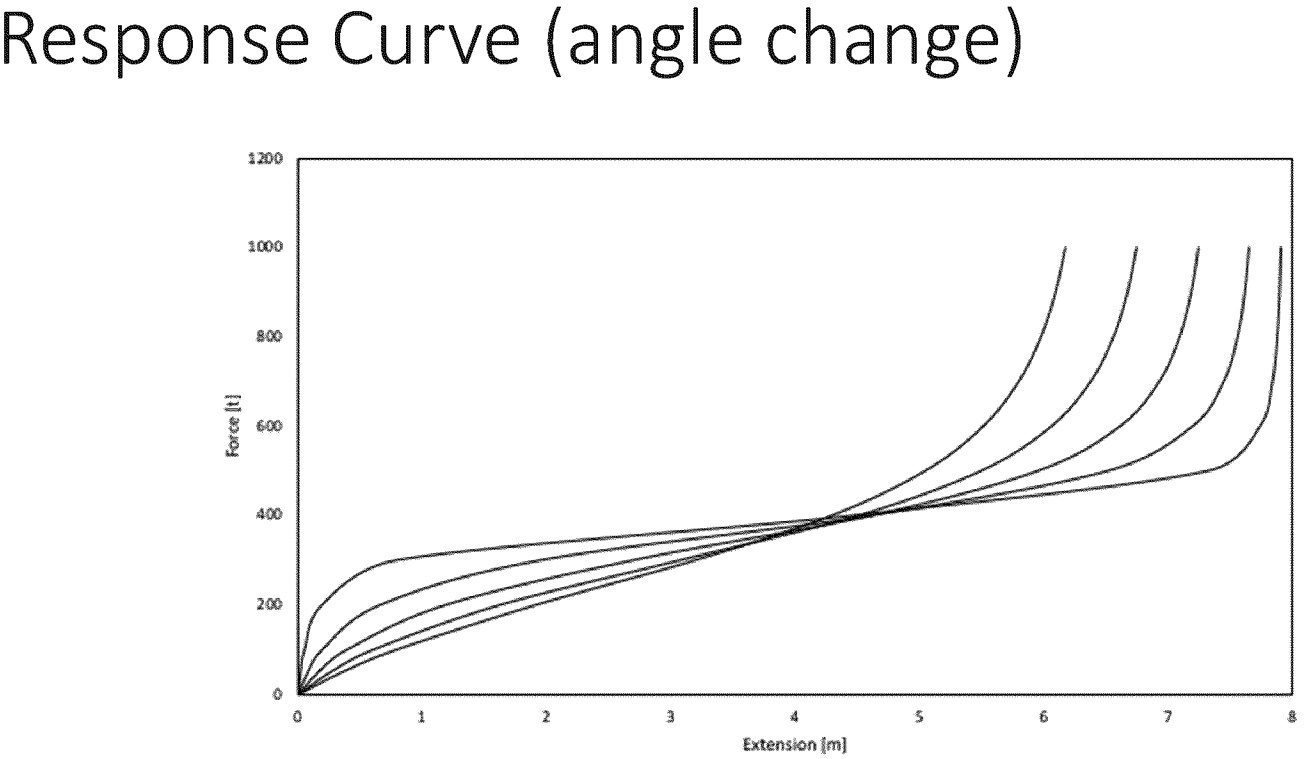
Figure 14E:
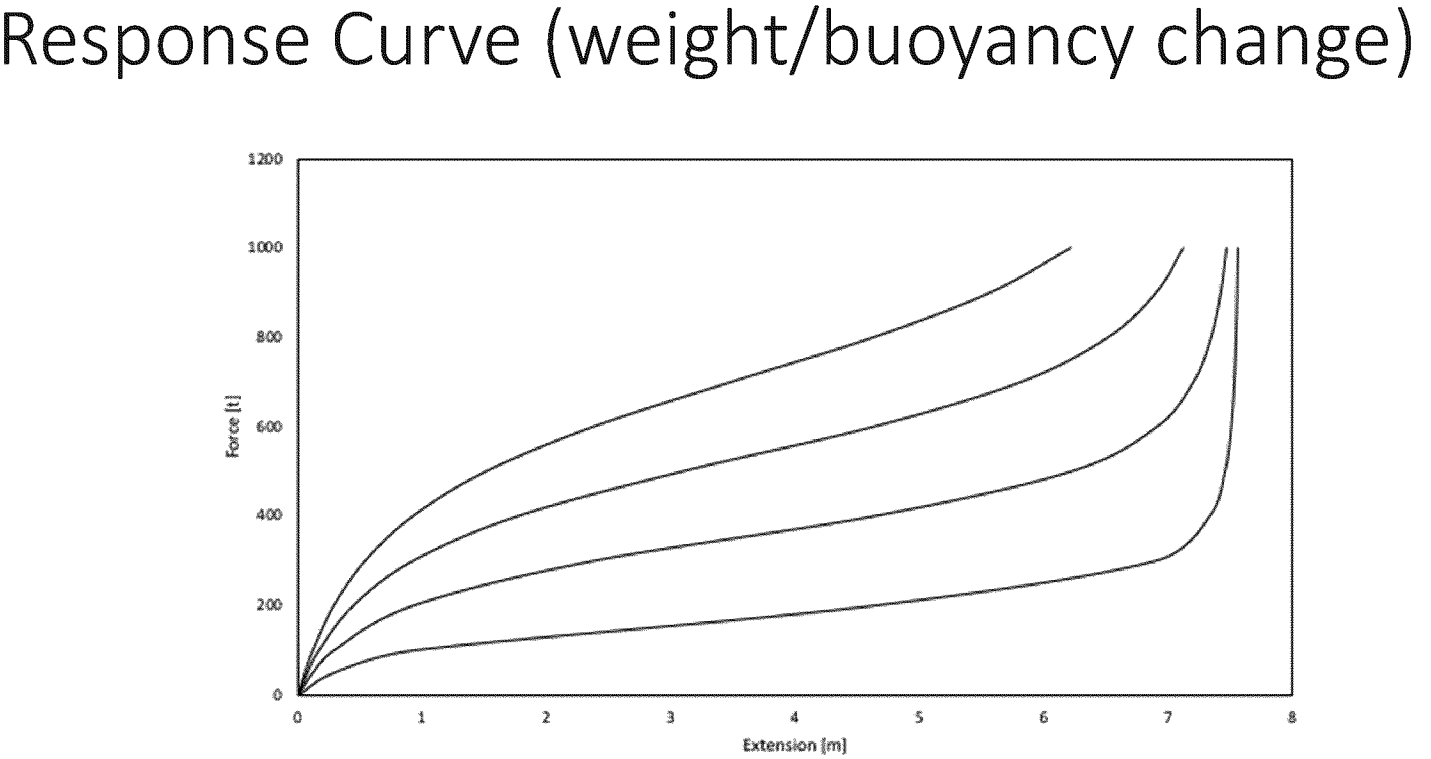

FIG. 14*e* illustrates various stiffness response curves which may be achieved by altering the buoyancy and/or weight of the first portion 24; 124 and second portion 26; 126.

A non-linear stiffness response such as some of the response curves described above is advantageous because the very stiff initial response ensures minimal extension of the mooring line under baseline preload, current or wind loading. Later the lower stiffness portion of the curve ensures a compliant response to load fluctuations above the baseline such as from waves.

Figure 16:
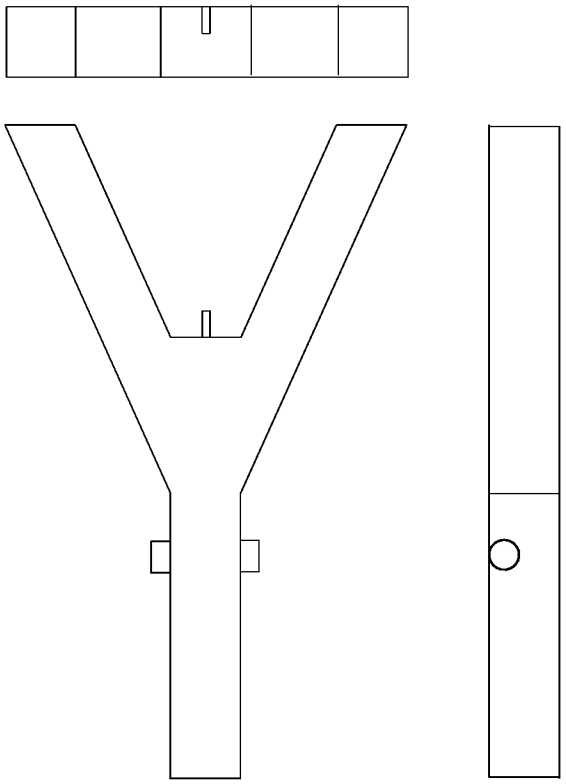
FIG. 16 illustrates a plan, elevation and end view of a further alternative shape of load reduction device according to the invention.
Figure 17:
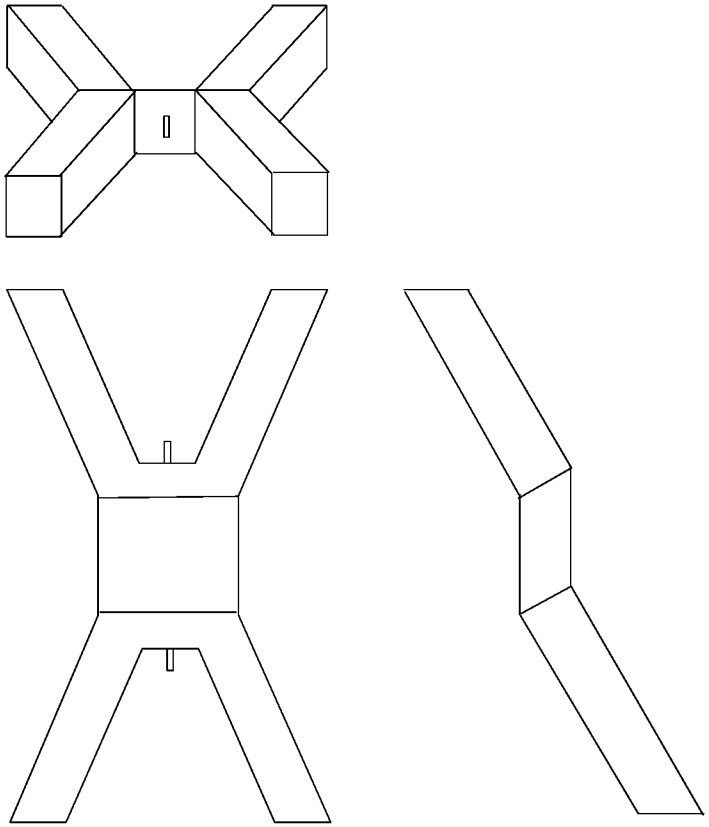
FIG. 17 illustrates a plan, elevation and end view of a still further alternative shape of load reduction device according to the invention.

Various modification or alternations to the design and configuration of the load reduction device of the invention are also envisaged. For example, referring to FIG. 15 there is illustrated a plan, elevation and end view of a load reduction device according to the present invention and having a substantially "X" shaped body, for example to facilitate large angles of rotational displacement. Similarly FIG. 16 illustrates a plan, elevation and end view of a substantially "Y" shaped body, and FIG. 17 illustrates a substantially "X" shaped body in which pairs of upper and lower limbs or portions of the body are inclined out of the main plane of the device.

Figure 18:
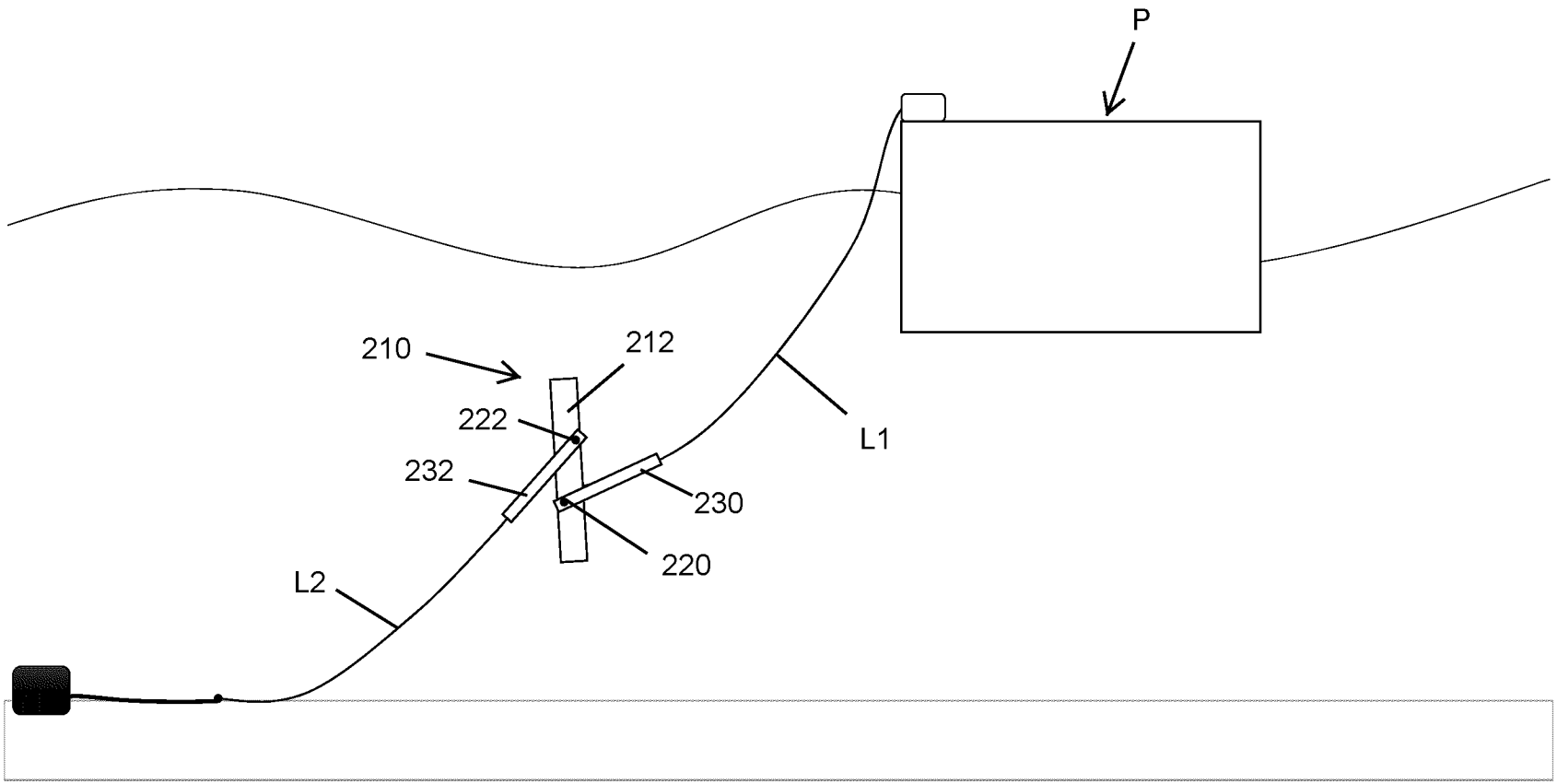
FIG. 18 illustrates a possible alternative connection of mooring lines to an embodiment of the load reduction device of the invention.

FIG. 18 illustrates an embodiment of a load reduction device according to the invention, generally indicated as 210, where the connecting end of each mooring line L1 and L2 is provided as a rigid element or arm 230; 232 pivotally connected to a body 212 of the device 210, with mooring connection points 220; 222 positioned such that an axis of rotation of the body 212 is located at or close to a centre of rotation of the body 212. The device 210 is illustrated schematically and may for example have defined buoyant and weighted portions (not illustrated) which may be suitably dimensioned to provide the required level of ballast and buoyancy as hereinbefore described.

Figure 19:
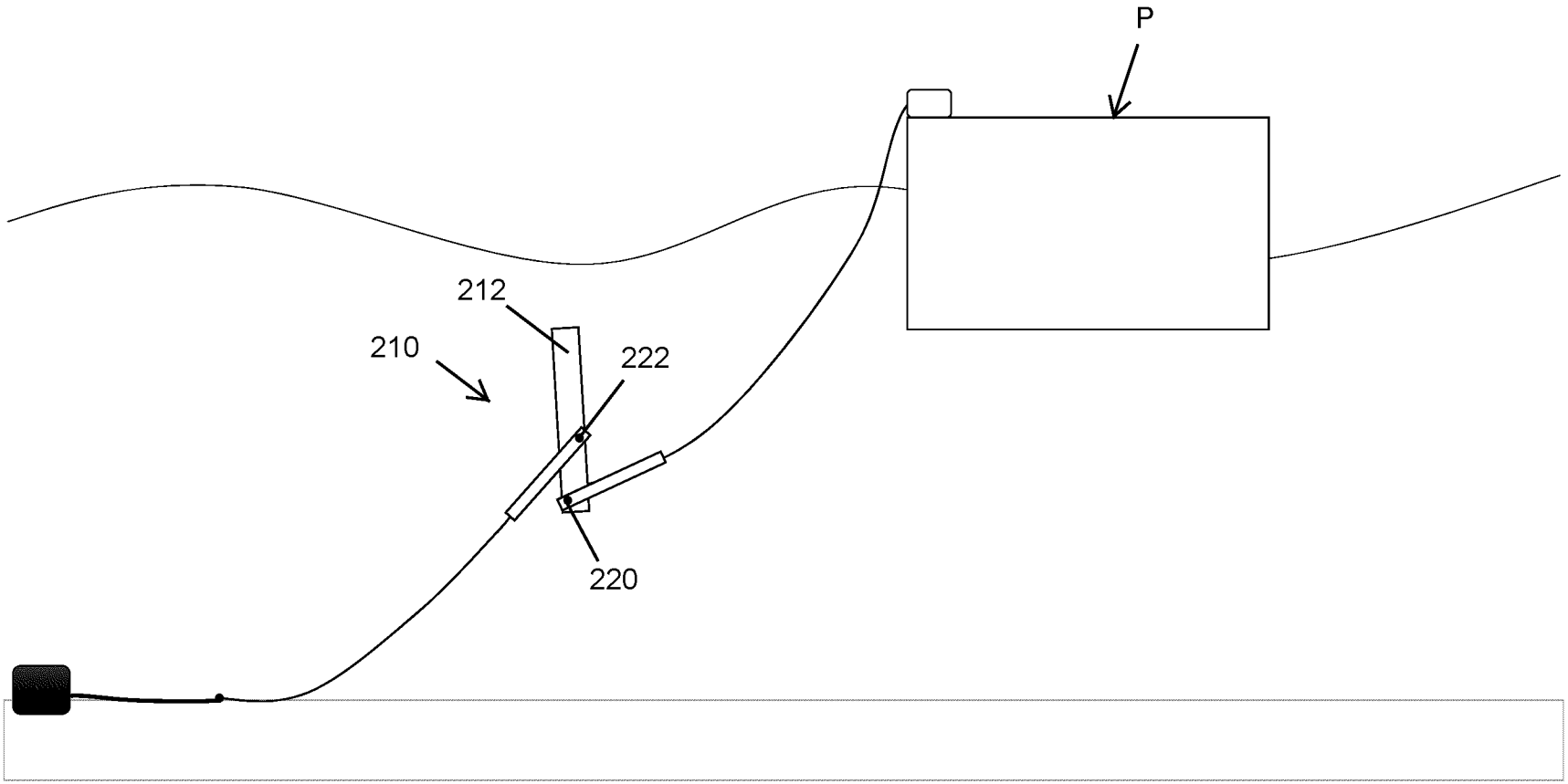
FIG. 19 illustrates a further possible alternative connection of mooring lines to an embodiment of the load reduction device of the invention.
Figure 20:
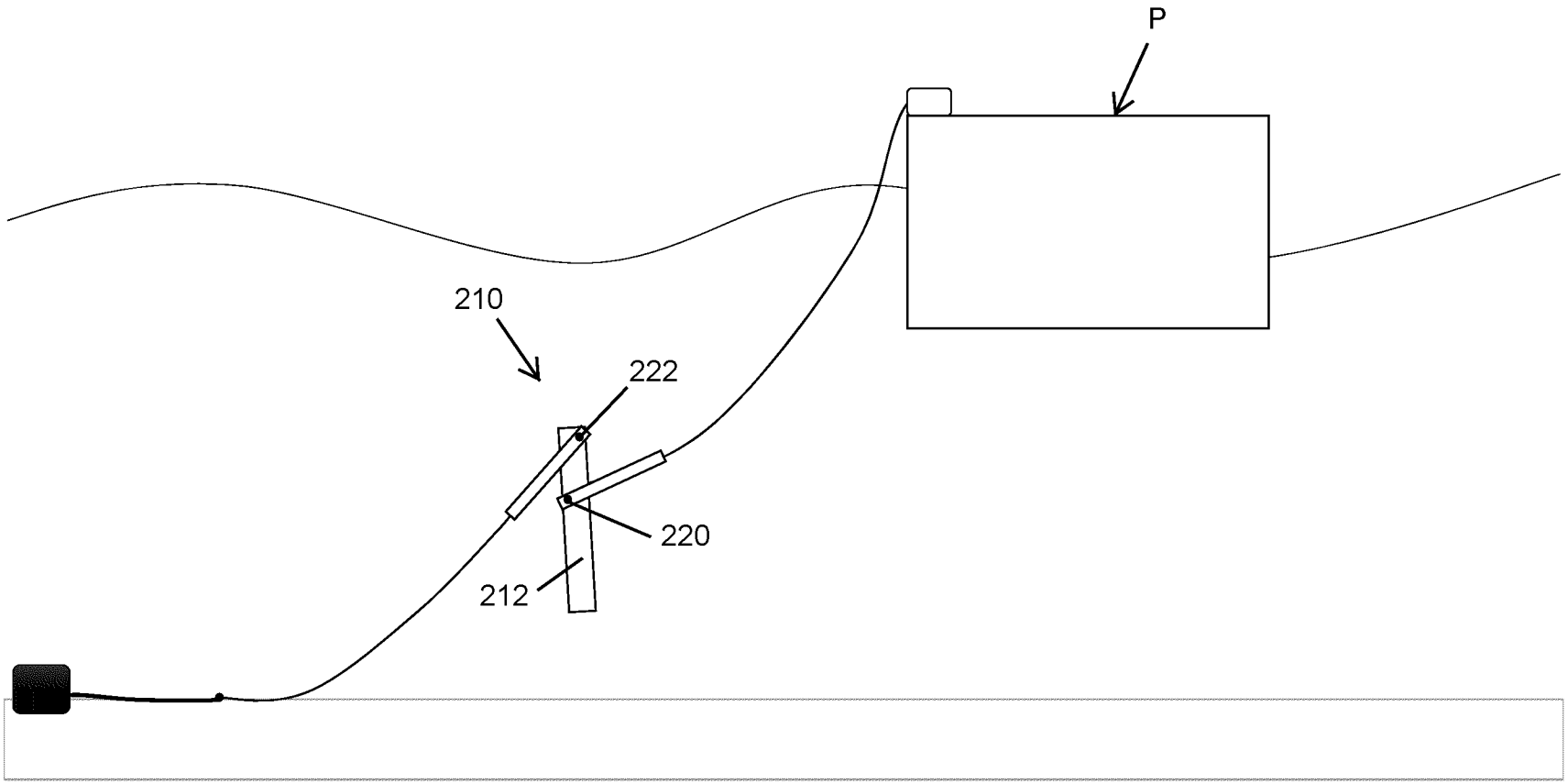
FIG. 20 illustrates a still further possible alternative connection of mooring lines to an embodiment of the load reduction device of the invention.
Figure 21:
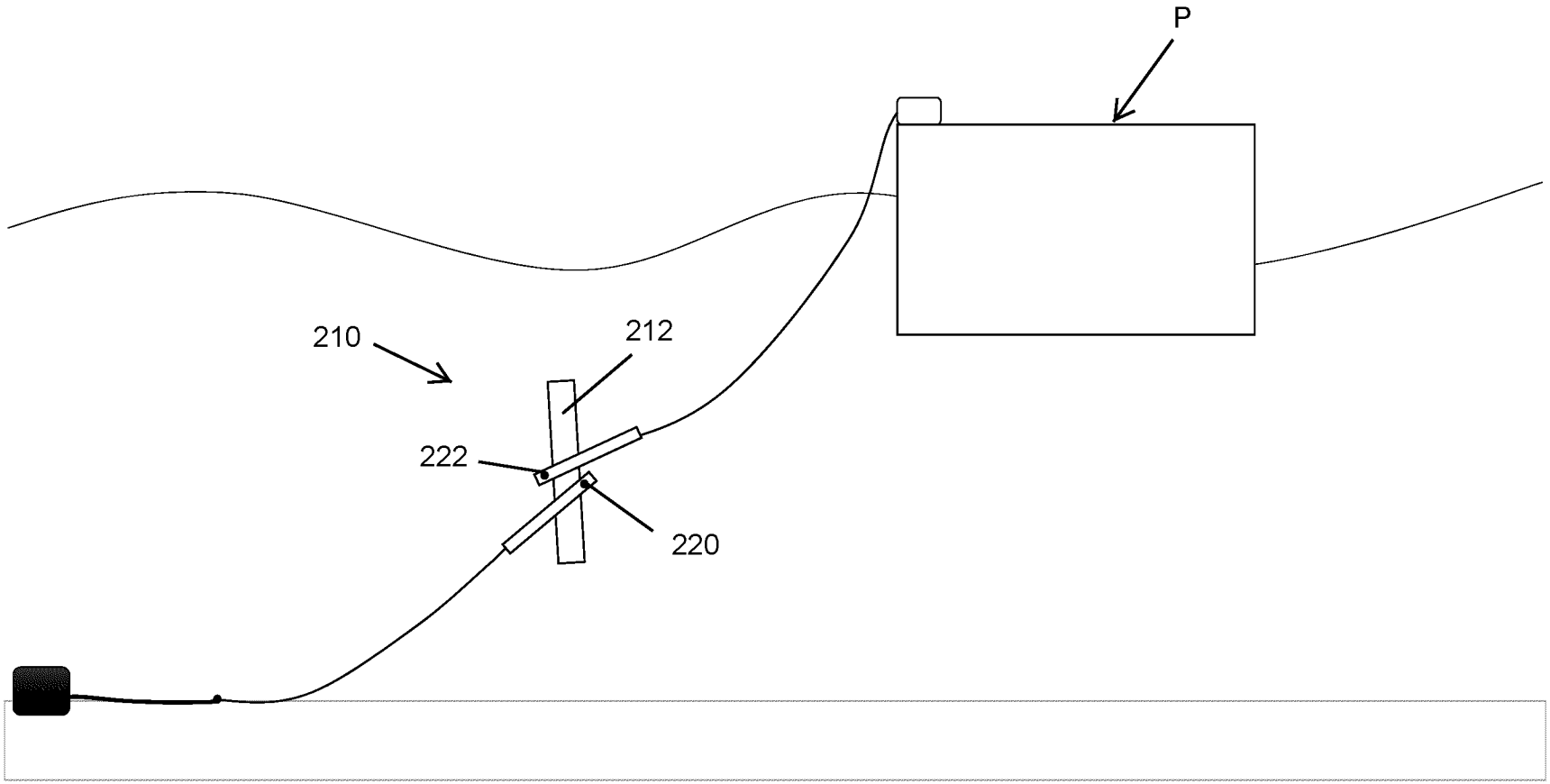
FIG. 21 illustrates an alternative cross over connection of mooring lines to an embodiment of the load reduction device of the invention.

FIG. 19 illustrates the load reduction device 210 of FIG. 18 but with the mooring connection points 220; 222 adjusted along the body 212 such that the axis of rotation of the body 212 is at or close to a centre of buoyancy of the body. FIG. 20 illustrates the load reduction device 210 of FIG. 18 but with the mooring connection points 220; 222 adjusted along the body 212 to be positioned towards an upper end of the body 212. FIG. 21 illustrates the load reduction device 210 but with a reversal of the connection of the mooring lines to the mooring connection points 220; 222, effectively resulting in the mooring lines crossing over the body 212 to the mooring connection points such as to effect rotation of the body 212 in the opposite direction to that described and shown in the previous arrangements. The rigid connection of the mooring lines to the body 212 permit the mooring lines freedom to rotate about an axis on the body 212 to prevent rotation about the device longitudinal axis or to prevent wear at the mooring line connections.

Referring now to FIG. 22 the load reduction device 210 is illustrated in various stages of a particular deployment methodology. It will be noted that a first or buoyant portion 224 and a second or weighted portion 226 of the body 212 are enlarged relative to the schematic illustrations of FIGS. 18 to 21, in order to more accurately reflect the characteristics required to provide the necessary load reduction function through the force couple biased rotation of the body 212 under the buoyant and weighted forces acting thereon to resist said rotation.

Figure 22B:
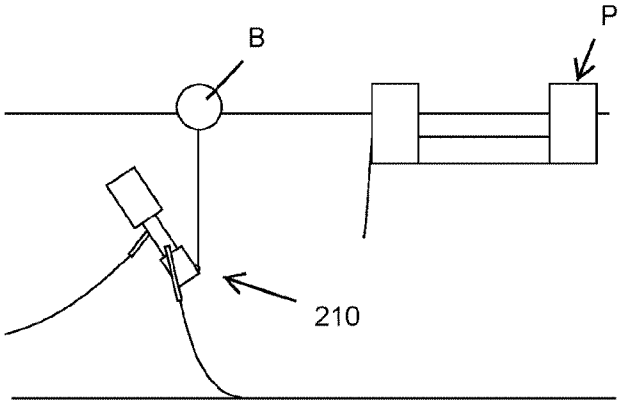
FIG. 22*b* illustrates the arrangement of FIG. 22*a* with the load reduction device being rotated upward by raising a weighted end thereof via a surface buoy prior to connection to the floating marine platform.
Figure 22A:
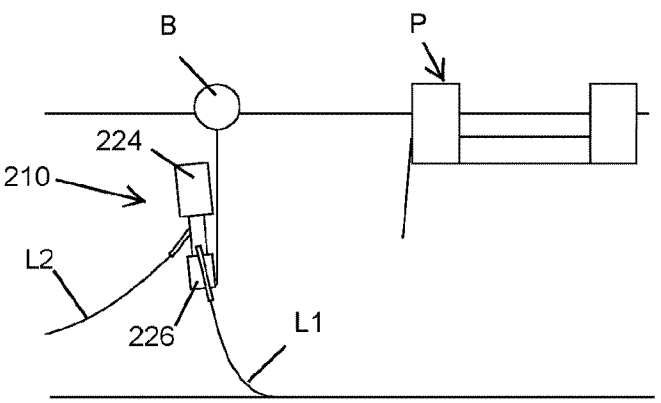
FIG. 22*a* illustrates a particular deployment methodology when using a load reduction device according to the invention as a mooring tensioner to secure a floating marine platform.

It can be seen in FIG. 22*a* that the load reduction device 210 is located adjacent a floating marine platform P, but is not initially connected to the platform P, with a first mooring line L1 left freely suspended from the device 210. The device 210, once in position adjacent the platform P, is anchored to the seabed via a second mooring line L2 as hereinbefore described in detail. The weighted portion 226 of the device 210 is tethered to a surface buoy B or any other suitable vessel.

FIG. 22*b* shows the next significant step in the deployment method, in which the weighted portion 226 is drawn upwardly via the connection to the buoy B or other vessel, causing the device 210 to rotate in a counterclockwise direction. At this stage the device can be said to be in a state of non equilibrium, or be unstable, but is maintained in this state by the connection to the buoy.

Figure 22D:
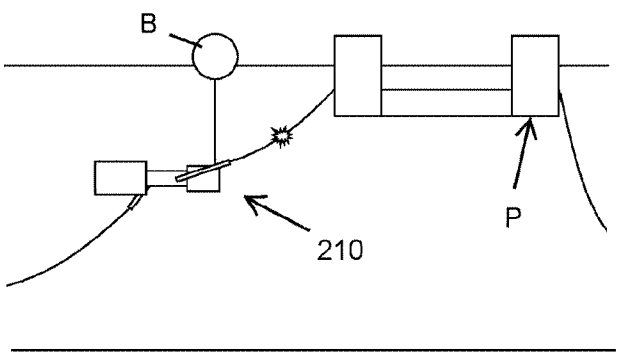
FIG. 22*d* illustrates the load reduction device being connected to the floating marine platform.
Figure 22C:
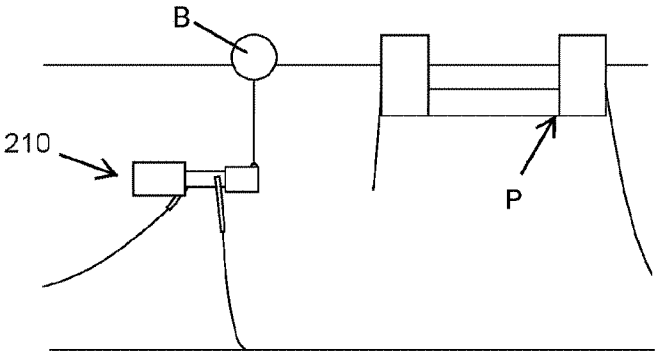
FIG. 22*c* illustrates the load reduction device rotated into a substantially horizontal position.
Figure 22E:
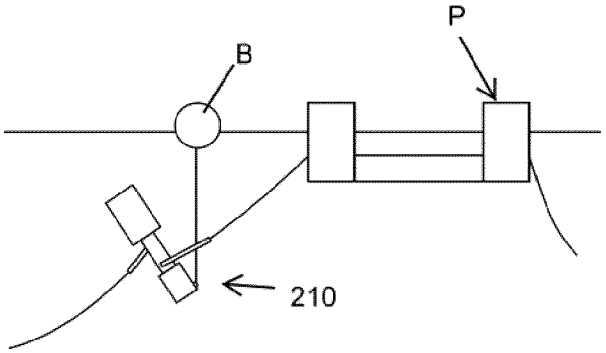
FIG. 22*e* illustrates the load reduction device connected to the floating marine platform and held in the substantially horizontal orientation.

FIG. 22*c* shows the device 210 has been rotated into a substantially horizontal orientation and held in this position by means of the connection to the buoy B. In FIG. 22*d* the device is connected to the platform P via the first mooring line L1 while remaining tethered to the buoy in order to allow the first mooring line to remain essentially free of tension during the connection to the platform P. FIG. 22*e* shows the arrangement once the connection to the platform P has been completed.

Figure 22F:
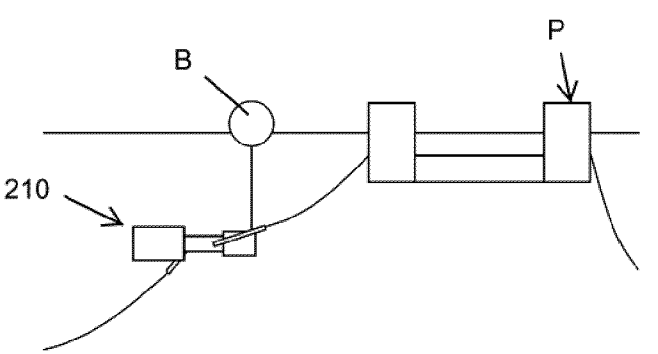
FIG. 22*f* illustrates the weighted end of the load reduction device being lowered.
Figure 22G:
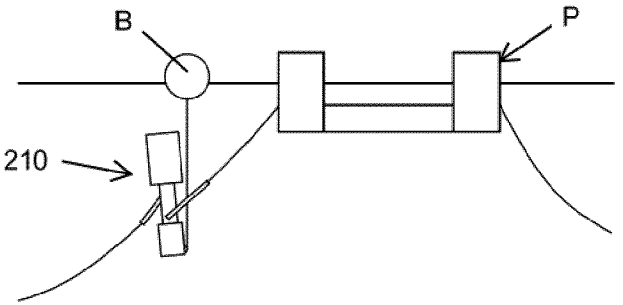
FIG. 22*g* illustrates the load reduction device fully lowered and thus rotated into a substantially vertical orientation, but still tethered to the surface.
Figure 22H:
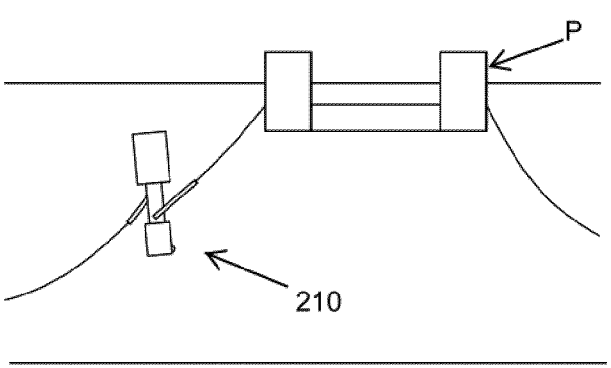
FIG. 22*h* illustrates the load reduction device once released from the surface tether.

FIG. 22*f* illustrates the weighted portion 226 being lowered back down by feeding out the line from the buoy B or other vessel, allowing the device to rotate back towards a stable orientation or state of equilibrium, and thus starting to add tension into the mooring lines L1 and L2. FIG. 22*g* illustrates the device 10 rotated fully into a substantially vertical orientation but with the buoy B still connected, while FIG. 22*h* shows the buoy B disconnected and the load reduction device 210 securing the platform P as hereinbefore described.

Referring now to FIG. 23 the load reduction device 210 is illustrated in various stages of an alternative deployment methodology. In order to facilitate this deployment methodology the first or buoyant portion and the second or weighted portion of the device 210 are hollow and fillable with buoyancy and ballast respectively and as hereinafter described, effectively defining a ballast tank and a buoyancy tank respectively.

Figure 23A:
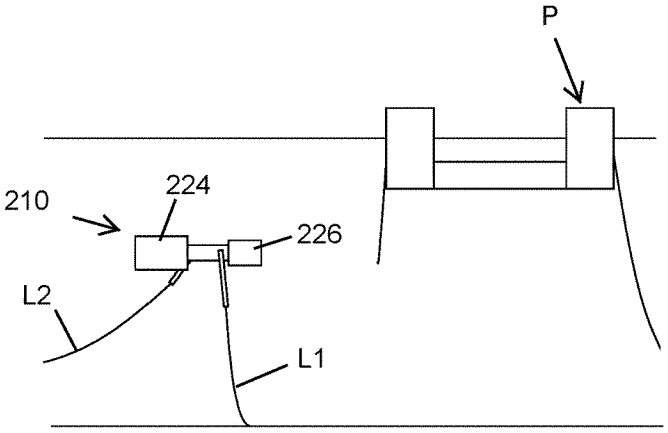
FIG. 23*a* illustrates an alternative deployment methodology when using a load reduction device according to the invention as a mooring tensioner to secure a floating marine platform, being anchored but not yet connected to the floating platform and in an un-ballasted state in a substantially horizontal orientation.

Thus referring to FIG. 23*a* the load reduction device 210 is located adjacent a floating marine platform P, but is not initially connected to the platform P, with a first mooring line L1 left freely suspended from the device 210. The device 210, once in position adjacent the platform P, is anchored to the seabed via a second mooring line L2 as hereinbefore described in detail. As the second or weighted portion of the device 210 is hollow and empty, the first or buoyant portion 224 may be filled with air or partially filled with water in order to achieve a desired orientation of the device 210, which for this deployment methodology is preferably substantially horizontal as illustrated.

Figure 23B:
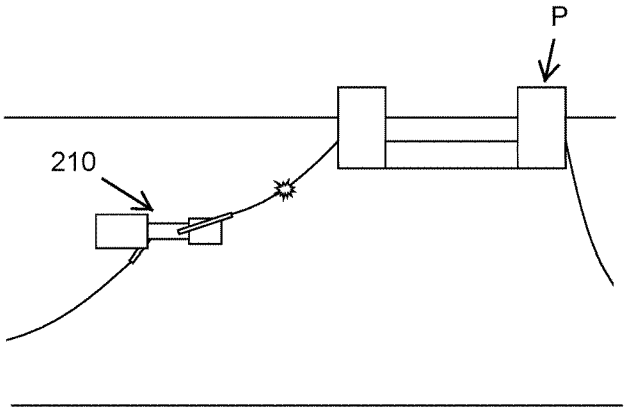
FIG. 23*b* illustrates the arrangement of FIG. 23*a* with the load reduction device being connected to the floating marine platform.
Figure 23C:
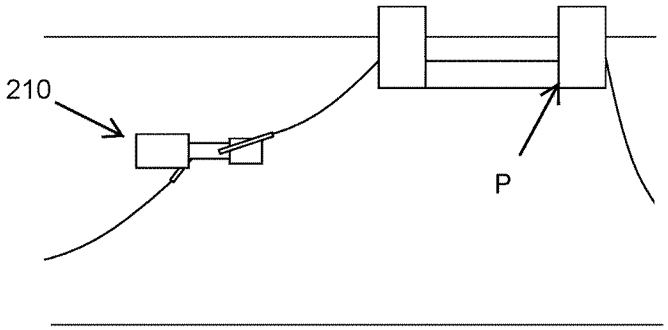
FIG. 23*c* illustrates the load reduction device connected to the floating platform and anchored.

FIG. 23*b* shows the device 210 being connected to the platform P via the first mooring line L1, which will remain essentially free of tension due to the horizontal orientation of the device 210. FIG. 23*c* shows the completed connection to the platform P.

Figure 23D:
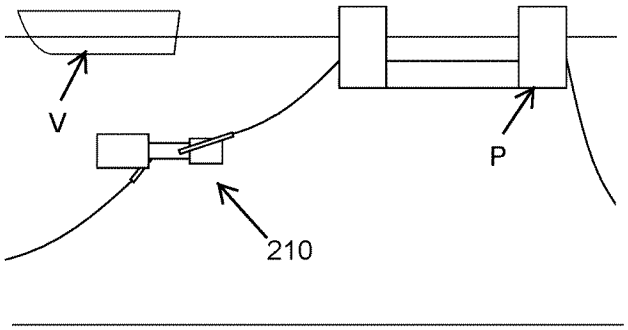
FIG. 23*d* illustrates a vessel being positioned above the load reduction device.
Figures 23E, 23F, 23G, 23H:
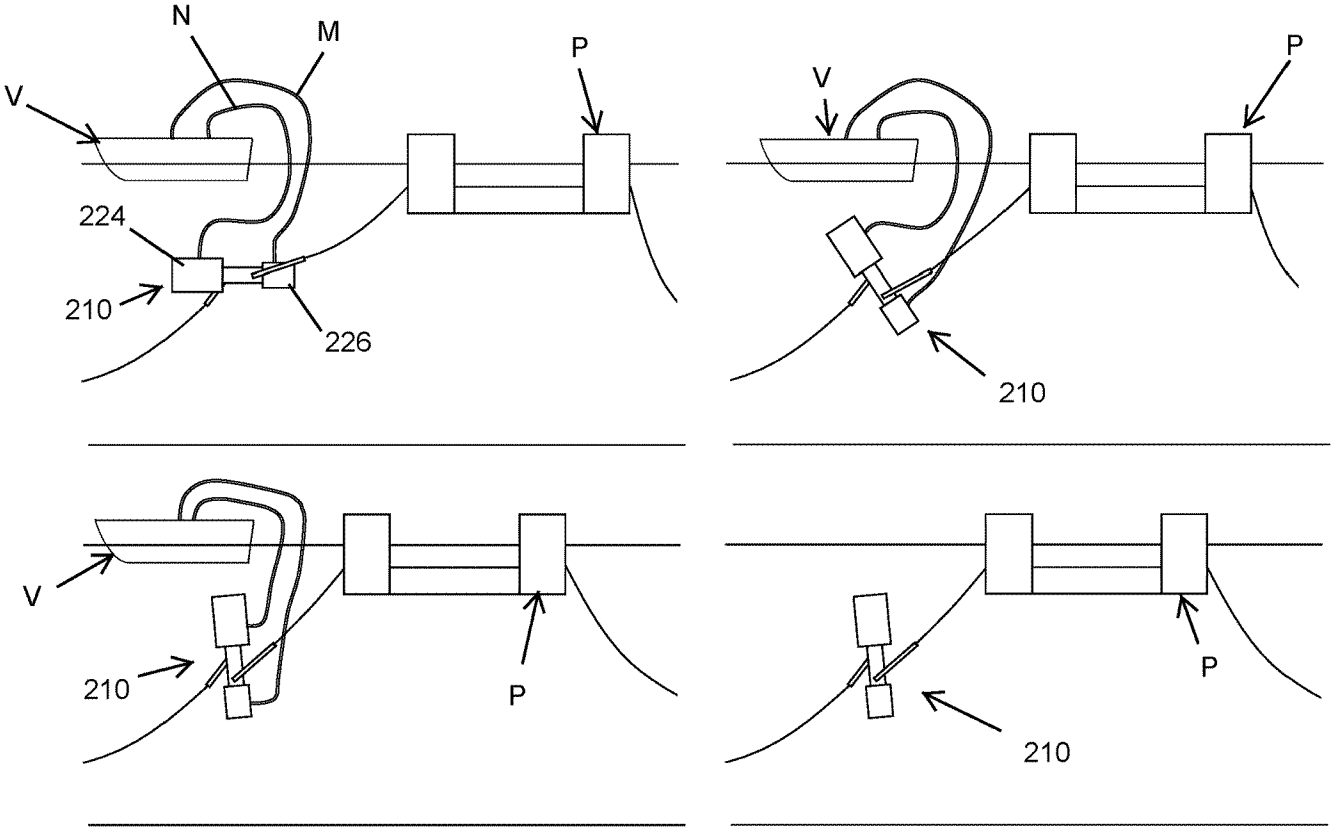
FIG. 23*e* illustrates ballast and buoyancy lines being connected from the vessel to the load reduction device.
FIG. 23*f* illustrates ballast and buoyancy being pumped into the load reduction device.
FIG. 23*g* illustrates the load reduction device fully ballasted and buoyant, with the ballast and buoyancy lines still connected.
FIG. 23*h* illustrates the load reduction device once the ballast and buoyancy lines have been disconnected.

FIG. 23*d* illustrates a vessel V being located adjacent the platform P and above the device 210, while FIG. 23*e* shows a ballast line M being connected between a ballast tank (not shown) on the vessel V and the second portion 226 and a buoyancy line N being connected between a buoyancy tank or source of air (not shown) on the vessel V and the first portion 224 of the device 210.

In FIG. 23*f* ballast is being pumped into the second portion 226 such as to increase the weight thereof, while air is pumped into the first portion 224 or water pumped out therefrom, thereby increasing the buoyancy thereof. This results in the creation of the above described force couple which acts to rotate the device 210 in a clockwise direction relative to the orientation shown in FIG. 23*e*. FIG. 23*g* shows the device following completion of the ballast and buoyancy pumping but with the lines M and N remaining connected, while FIG. 23*h* showns the lines disconnected and the device 210 fully operational for mooring the platform P. It is also envisaged that rather than pumping ballast and/or buoyancy into the body 212, a ballast block (not shown) and/or a buoyant block could be added to the body 212 once located in the body of water adjacent the platform P. It should therefore be understood that the terms "ballast tank" and "buoyancy tank" should be interpreted as covering such an arrangement where an actual tank or enclosure is not required.

Turning to FIG. 24 the load reduction device 210 is illustrated in various phases of deployment and operation in mooring a marine platform P using substantially vertical mooring lines L1 and L2 such as to accommodate tidal variations in water level while maintaining a relatively consistent tension in the mooring lines. In the method illustrated two or more, typically three or four of the devices 210 are employed, along with corresponding mooring lines L1 and L2.

Figure 24B:
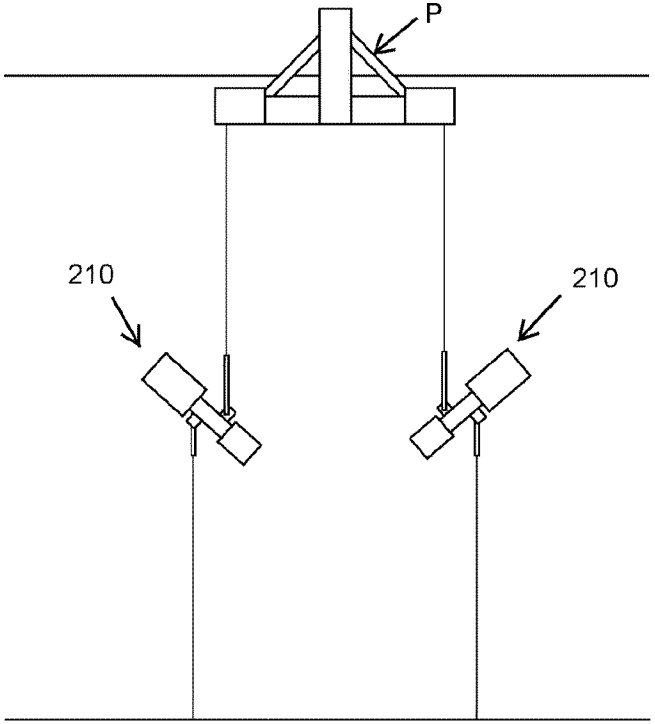
FIG. 24*b* illustrates the arrangement of FIG. 24*a* with the mooring lines pre-tensioned and the load reduction devices rotated towards a horizontal orientation.
Figure 24A:
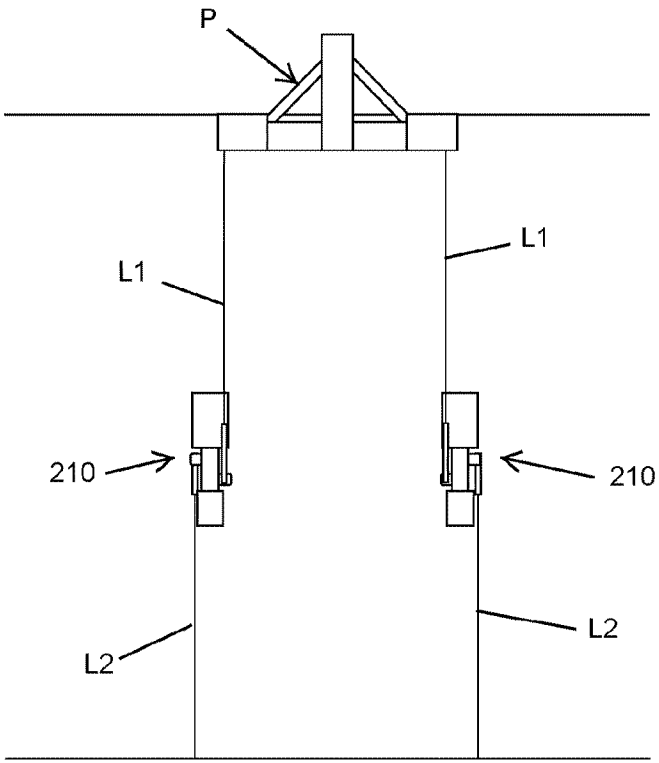
FIG. 24*a* illustrates a deployment methodology when using a load reduction device according to the invention for managing tension when securing a floating marine platform via vertical mooring lines, being anchored but with the mooring lines not yet tensioned.

In FIG. 24*a* the devices 210 are initially installed in a substile vertical orientation and the mooring lines L1 and L2 are under very low or negligible tension. The mooring lines L1 and L2 are then pretensioned by any suitable conventional means, for example winches located on the platform P, causing the devices to rotate towards a horizontal orientation against the bias of the force couple.

Figure 24D:
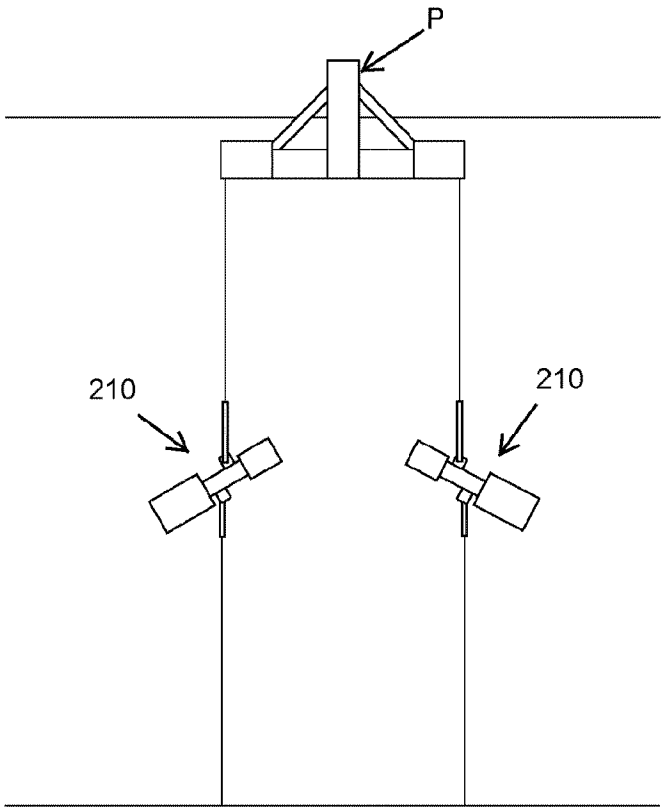
FIG. 24*d* illustrates the floating platform at highest astronomical tide.
Figure 24C:
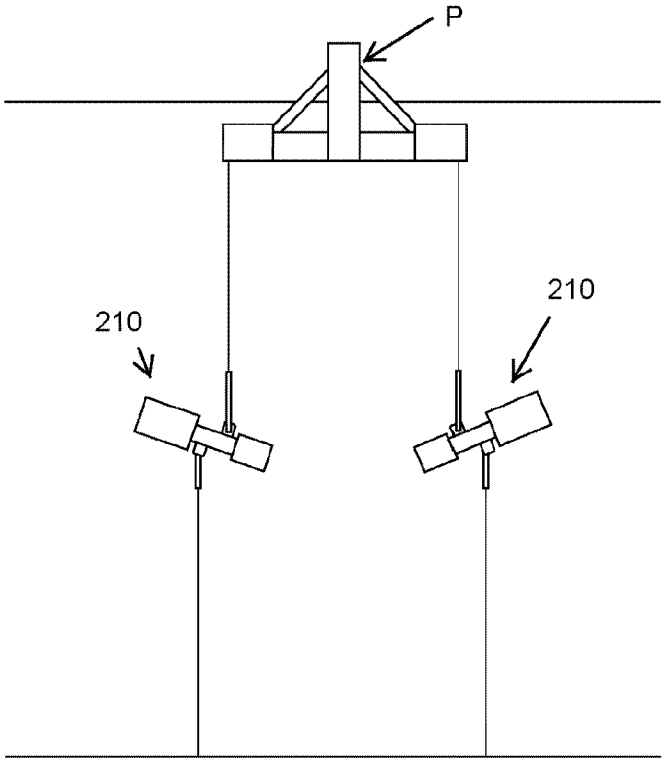
FIG. 24*c* illustrates the floating platform at lowest astronomical tide.

The load reduction devices 210 are configured or tuned as hereinbefore described such as to have a stiffness curve which results in the devices 210 rotating in response to tidal range variation with minimal change in tension in the mooring lines L1 and L2. FIG. 24*c* shows the platform at lowest astronomical tide with the devices 210 rotated in a pre-horizontal orientation, while FIG. 24*d* shows the platform at highest astronomical tide with the devices 210 rotated beyond a horizontal orientation to effectively increase the combined length of the lines L1 and L2 in line with the tidal variation, thereby avoiding significant changes in tension. It will of course be understood that the horizontal orientation is used here merely as an illustrative example of the relative position of the devices 210 between the two extremes of tidal levels. The devices 210 will also react to environmental loading as hereinbefore described in order to reduce mooring line tension and/or peak and/or fatigue load.

FIG. 25 illustrates an alternative embodiment of a buoyant rotatable marine transducer embodying a load reduction device, generally indicated as 310. In this alternative embodiment like components have been accorded like reference numerals and unless otherwise stated perform a like function. The device 210 comprises a buoyant body have a first buoyant portion 324 and a second weighted portion 326 spaced from one another. The device further comprises a first and second arm 330; 332 pivotally mounted to the body 312 for connection of first and second morning lines as hereinbefore described. Unlike the previous embodiments the device 310 further comprises first and second springs 340; 342, the first spring being mounted beyond the weighted portion 326 and the second spring being mounted beyond the buoyant portion 324. It will be understood that the position, type and arrangement of the springs 340; 342 may be varied while retaining the desired functionality thereof, and the device 310 merely exemplifies one possible configuration. It will also be understood that a single spring could be employed, as could more that the two springs shown. It should also be understood that in place of or in combination with the spring(s), an end stop or bumper (not shown) could be provided in order to limit the range of rotational movement and thus extension that the device 310 can undergo, in addition to limiting rotation in a clockwise direction. The use of the term "spring" is intended to also cover such an end stop or other deformable element whether alone or in combination with another spring.

Figure 25A:
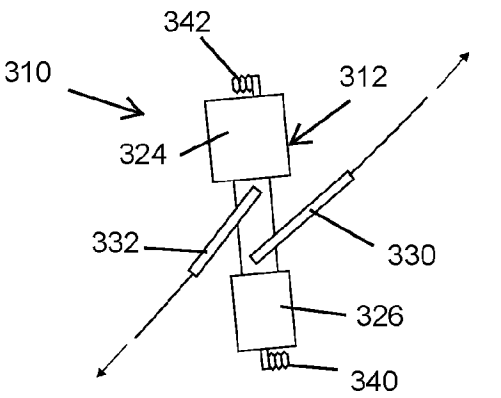
FIG. 25*a* illustrates an alternative embodiment of a load reduction device according to an aspect of the present invention, incorporating a pair of springs to tune the stiffness response of the device.
Figure 25B:
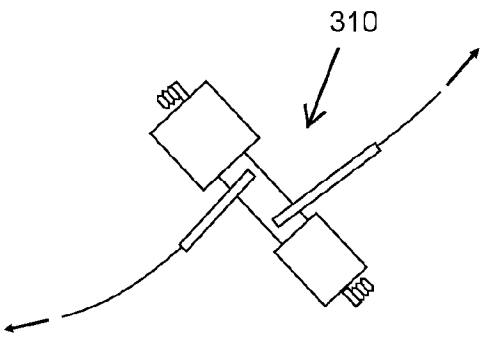
FIG. 25*b* illustrates the load reduction device partially rotated in response to external loading.
Figure 25C:
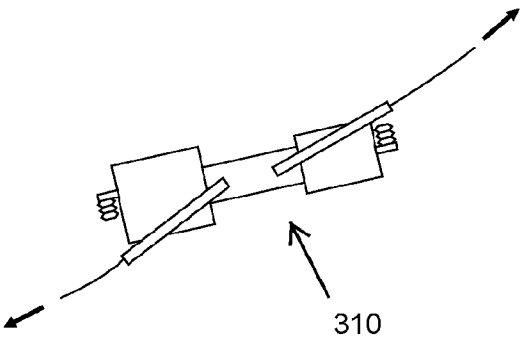
FIG. 25*c* illustrates the load reduction device substantially fully rotated to an orientation in which the springs are about to be compressed.
Figure 25D:
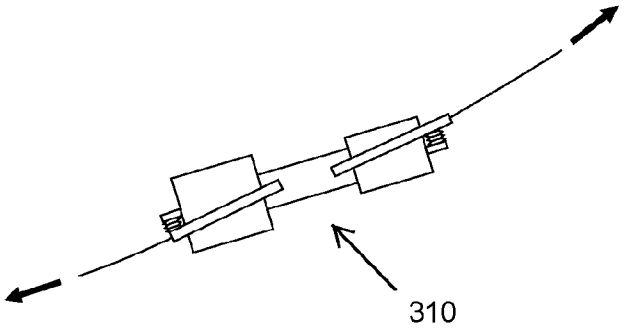
FIG. 25*d* illustrates the load reduction device rotated to the point where the pair of springs are undergoing compression.

As described hereinafter, the springs 340; 340 are operable to alter the stiffness response of the device 310 in a phased manner, effectively allowing an additional phase of stiffness response beyond that described above with reference to the non-linear stiffness response curve. FIG. 25*a* shows the device 310 in a substantially vertical and therefore unloaded state. FIG. 25*b* shows the device 310 under load and having undergone an amount of rotational displacement. FIG. 25*c* shows a progression of this rotation in which the pair of arms 330; 332 have rotated relative to the body 312 to an extent that they are approaching the respective spring 340; 342 and/or endstop (not shown). Finally FIG. 25*d* shows the device having undergone sufficient rotation for the arms 330; 332 to have come into contact with and effected compression of the springs 340; 342. Compression of the springs 340; 342 will serve to control the stiffness response of this final phase of rotation of the body.

Figure 26B:
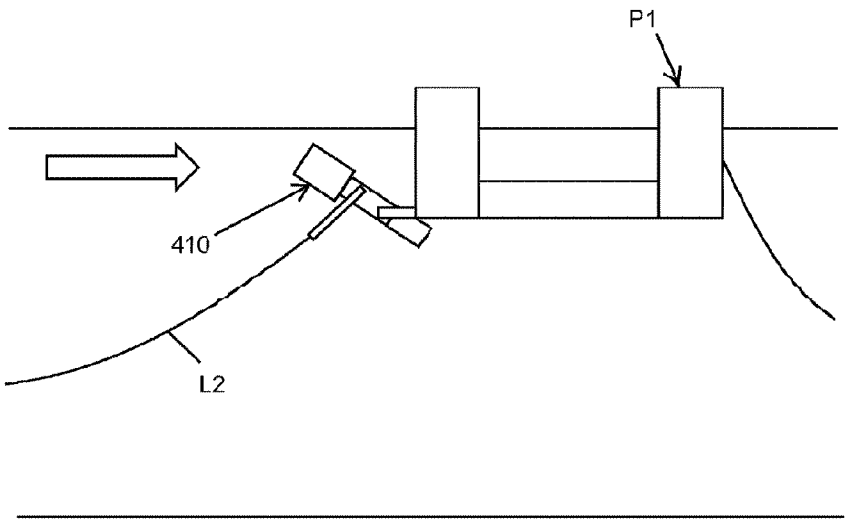
FIG. 26*b* illustrates the load reduction platform of FIG. 26*b* in a loaded state.
Figure 26A:
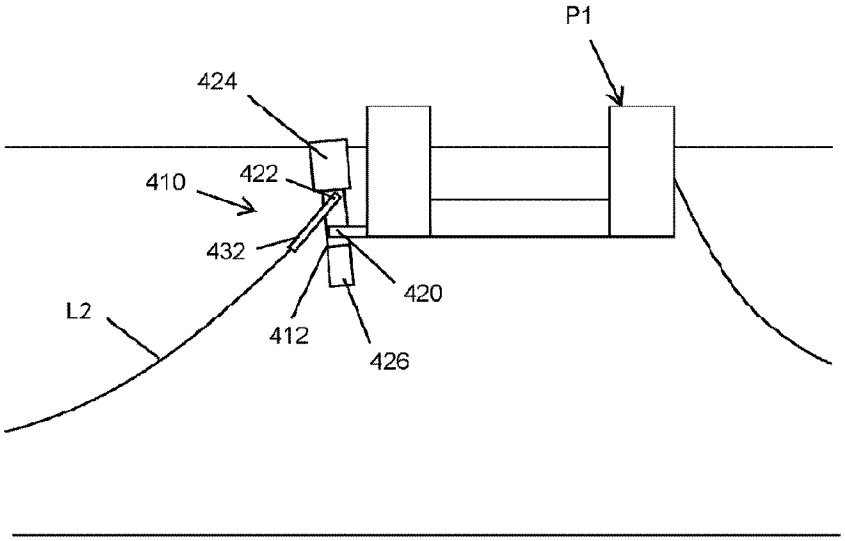
FIG. 26*a* illustrates a load reduction platform according to an aspect of the present invention, incorporating an integrated load reduction device according to another aspect of the invention, the platform being in a substantially unloaded state.

Turning to FIG. 26*a* there is illustrated a marine platform P1 according to an aspect of the present invention, incorporating a buoyant rotatable marine transducer in the form of a load reduction device 410 integrated with the platform P1. The load reduction device 410 operates essentially in the same manner as hereinbefore described, having a body 412 defining a buoyant portion 424 and a weighted portion 426, and a pair of mooring connection points 420; 422. However unlike previous embodiments the first mooring connection point defines a connection directly to the platform P1 and about which the body 12 can rotate. The second mooring connection point has a second arm 432 pivotally connected thereto and from which extends a second mooring line L2 which is anchored or otherwise secured as hereinbefore described. It is also envisaged that the platform P1 could be provided without the rigid second arm 432 and directly connecting the mooring line L2 to the mooring connection point 422.

In the absence of significant environmental loading, and as illustrated in FIG. 26*a*, the body assumes a substantially vertical orientation under the influence of the force couple generated by the buoyant portion 424 and the weighted portion 426. However, as illustrated in FIG. 26*b*, when an external environment force such as wind, wave, tide, etc. acts on the platform P1 the device 410 undergoes rotation against the action of the force couple in order to reduce the load on the platform P1 by converting a portion of the load into the rotational displacement of the device 410.

Although the platform P1 is shown with only a single integrated load reduction device 410 it is to be understood that a second or additional devices 410 may be provided as part of the platform P1.

Figure 27B:
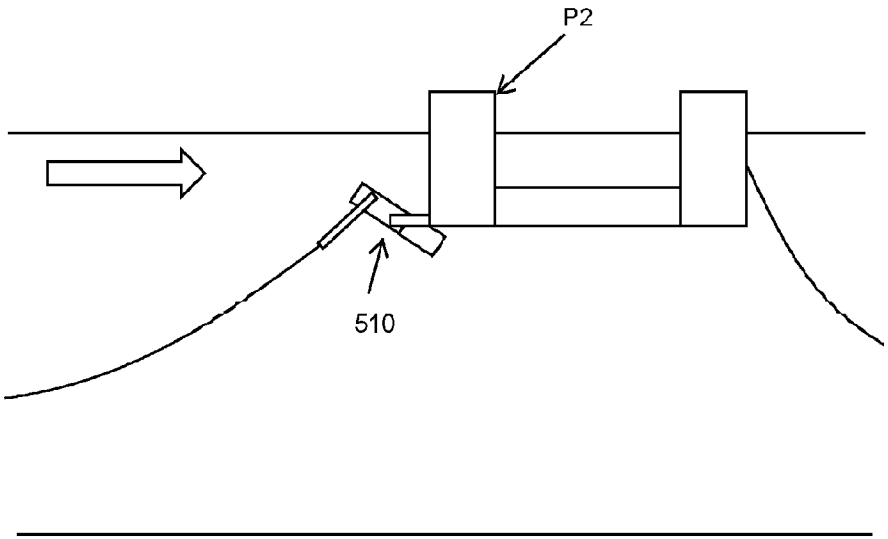
FIG. 27*b* illustrates the load reduction platform of FIG. 27*a* in a loaded state.
Figure 27A:
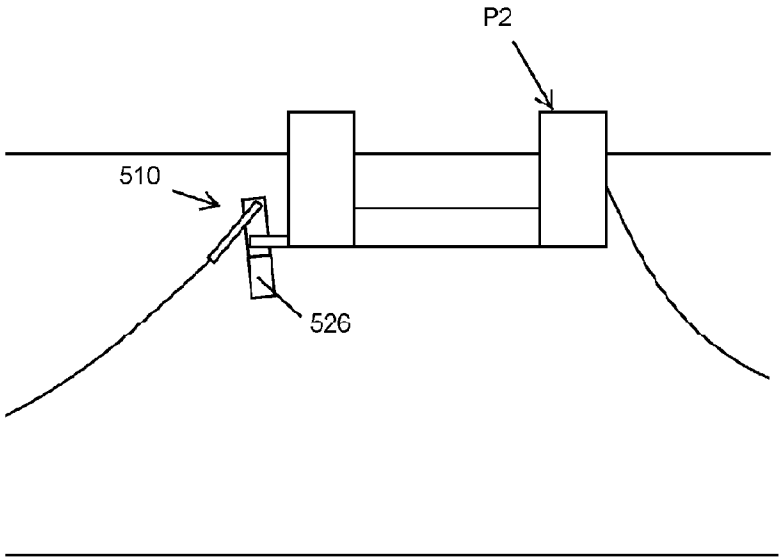
FIG. 27*a* illustrates an alternative embodiment of a load reduction platform according to as aspect of the present invention, incorporating an integrated pair of load reduction devices and in a substantially unloaded state.

Referring to FIGS. 27*a* and 27*b* a similar arrangement is shown, in which a platform P2 is provided with a buoyant rotatable marine transducer in the form of a load reduction device 510 integrated with the platform P2. Unlike with the platform P1, the load reduction device 510 does not include a buoyant portion and relies instead solely on a weighted portion 526, such that the force acting against the external environmental forces is generated only by the resistance of the weighted portion against rotation of the device 510. As with the platform P1 it is to be understood that a second or additional devices 510 may be provided as part of the platform P2.

Figure 28B:
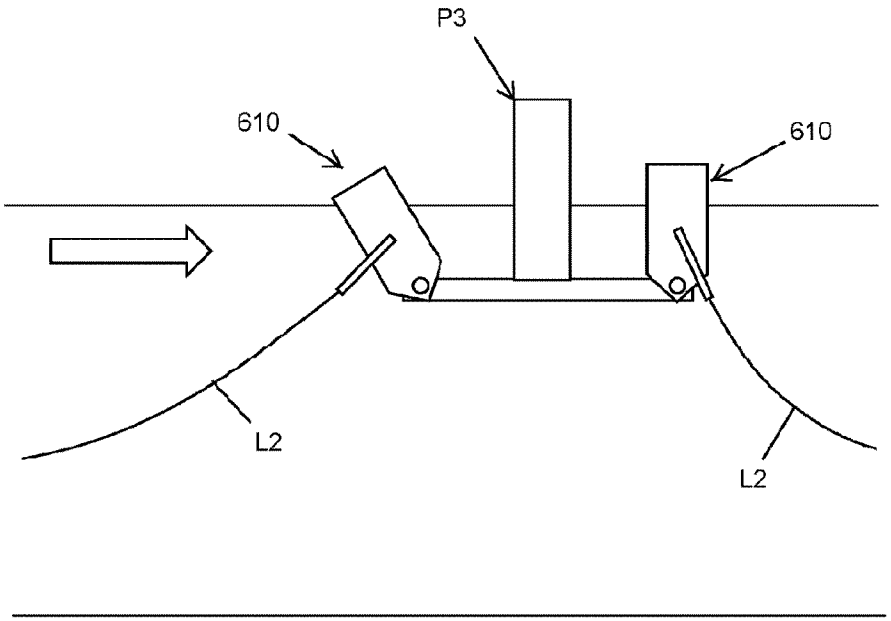
FIG. 28*b* illustrates the load reduction platform of FIG. 28*a* in a loaded state.
Figure 28A:
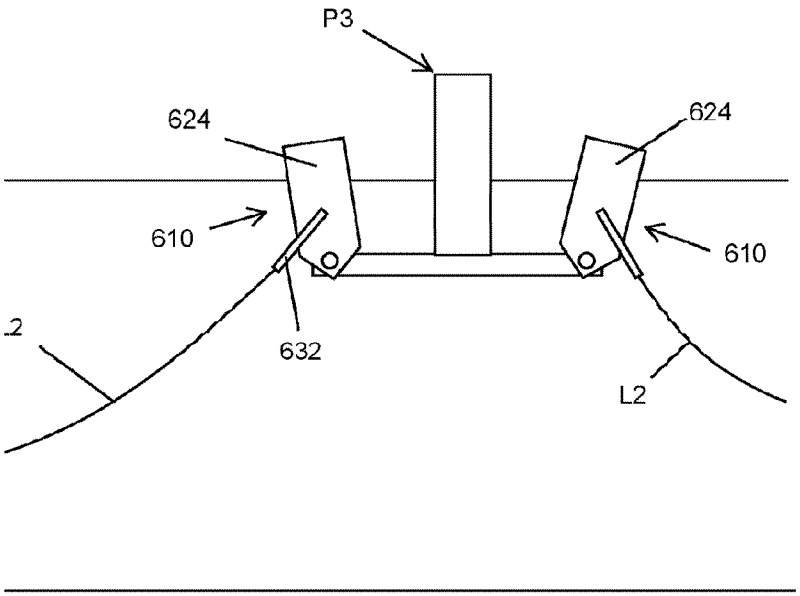
FIG. 28*a* illustrates a further alternative embodiment of a load reduction platform according to an aspect of the present invention, incorporating an integrated pair of buoyant load reduction devices and in a substantially unloaded state.
Figure 29C:
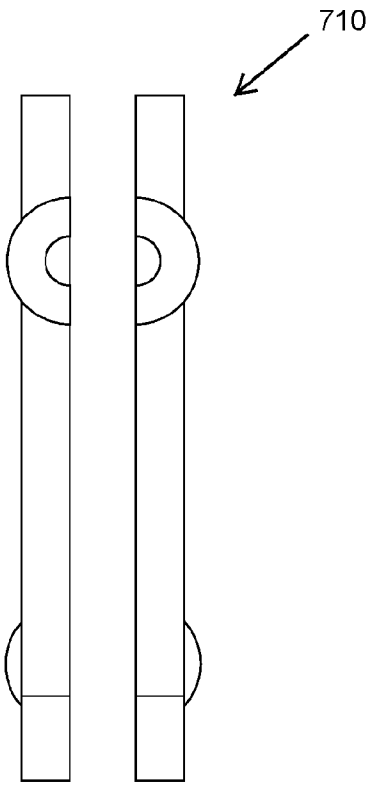
FIG. 29*c* illustrates the device with the body opened to provide access to the full length of the passage.
Figure 29B:
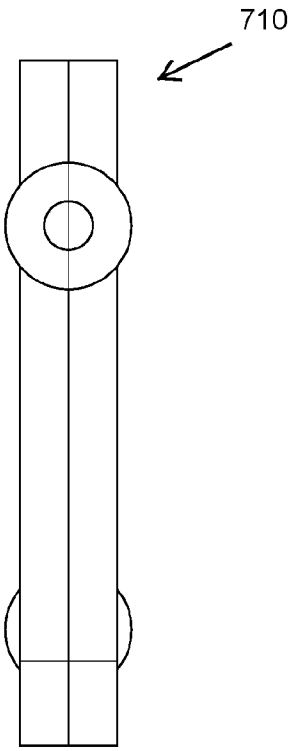
FIG. 29*b* illustrates a front elevation of the device illustrated in FIG. 29*a;*
Figure 29A:
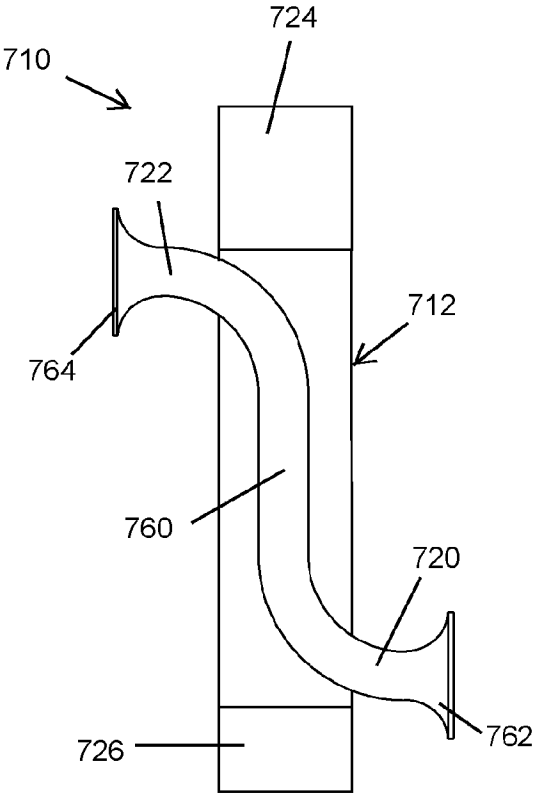
FIG. 29*a* illustrates a side elevation of a further alternative embodiment of a load reduction device according to an aspect of the present invention, incorporating a passage through a body of the device terminated at either end by a bend restrictor.
Figure 29E:
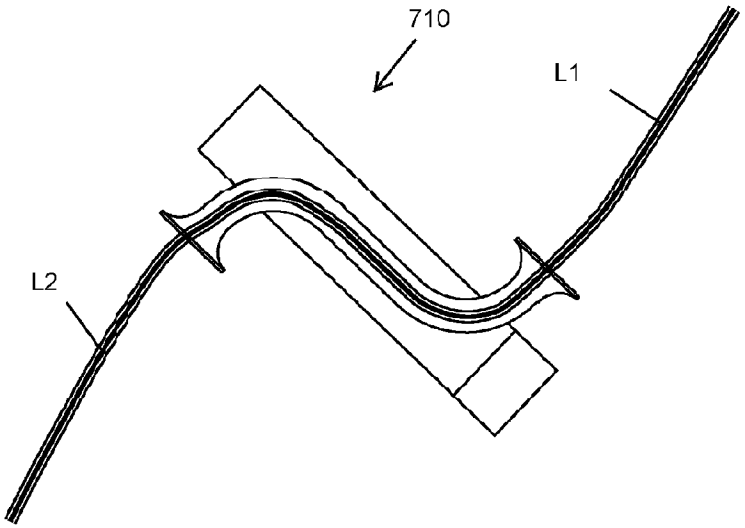
FIG. 29*e* illustrates the device as shown in FIG. 29*d* but in a loaded state and having undergone consequential rotation.
Figure 29D:
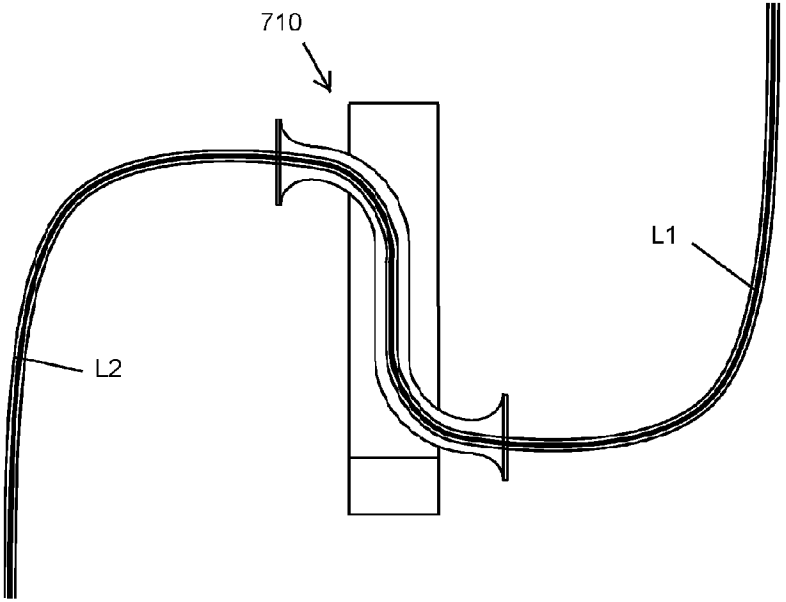
FIG. 29*d* illustrates the device with a cable or line passing therethrough and in a substantially unloaded state.

FIGS. 28*a* and 28*b* illustrate a further embodiment of a marine platform P3 according to an aspect of the invention and incorporating a pair of buoyant rotatable marine transducers in the form of load reduction devices 610 integrated with the platform P3. The configuration of the devices 610 is essentially the reverse of the devices 510 on the platform P2, whereby each load reduction device 610 does not include a weighted portion and relies instead solely on a buoyant portion, such that the force acting against the external environmental forces is generated only by the resistance of the buoyant portion against rotation of the device 510. The arrangement of the platform P3 and the devices 610 must therefore ensure that the buoyant portion 624 is substantially submerged, and in the embodiment illustrates the two buoyant portions actually provide a substantial amount of the buoyancy and displacement required to float the whole platform P3.

Referring to FIG. 29 a further alternative embodiment of a buoyant rotatable marine transducer embodying a load reduction device is provided, generally indicated as 710. In this alternative embodiment like components have been accorded like reference numerals and unless otherwise stated perform a like function. The device 710 comprises a buoyant body 712 having a first buoyant portion 724 and a second weighted portion 726 defining opposed ends of the body in a longitudinal direction. The body 712 defines a passage 760 extending therethrough in a substantially longitudinal direction, but exiting the body 712 transversely to effectively define a first mooring connection point 720 and a second mooring connection point 722, allowing a single length of line to pass through the passage 760 such as to define the first mooring line L1 on one side of the body and a second mooring line L2 on the other side of the body 712. The line may be a power cable, wire rope, chain, etc. The device 710 preferably incorporates a first bend restrictor 762 defining the first mooring connection point 720 and a second bend restrictor 764 defining the second mooring connection point 722 in order to prevent damage to the line. The body 712 may be formed as a pair of separable sections or halves as illustrated in FIG. 29*c* in order to allow the device to be clamped around an existing cable or line. This particular design of load reduction device avoids snatch loads in cables and maintains curvature within an allowable range, which can be critical in certain applications.

The load reduction device of the invention may also be modular in construction in order to ease manufacture and/or transport and/or installation or retrieval. The body of the device may be shaped and dimensioned to increase or reduce inertial loading such as by entrainment of water during rotation. The body may be provided with multiple mooring connection points for different responses. The body may be provided with only a ballasted portion, or conversely with only a buoyant portion. The load reduction device may be adapted to enable the dynamic and/or autonomous control of the level of ballast, buoyancy, or the position of the mooring connection points, such as in response to large waves or other environmental information like weather forecasting or the like, and which may be monitored by providing the load reduction device within one or more sensors and/or receivers. The load reduction device may also include some form of energy capture take off system (not shown) in order to harness power from the environmental forces acting thereon, for example to power one or more on-board systems such as the above mentioned adaptive ballasting or buoyancy. It should also be understood that the load reduction device of the invention may be used in combination with or as a sub-component within a mooring system comprising other components, for example with an overall mooring configuration where multiple load reduction means are utilised.

It will therefore be appreciated that the buoyant rotatable marine transducer embodying the load reduction devices 10, 110; 210; 310; 410; 510; 610; 710 and associated load reduction systems provides a simple yet highly effective means of translating one form of energy or motion into another. This functionality facilitates marine applications such as securing a platform or other structure and attenuating extreme environmentally induced forces applied thereto, and which allows the stiffness response curve to be adjusted or tuned in a number of ways in order to provide a desired load handling performance.

It should also be appreciated that while the above embodiments utilise the buoyant rotatable marine transducer as a load reduction device, alternative applications are also possible. In particular the rotatable buoyant marine transducer of the invention may be used as a sensor system (not shown) which comprises one or more sensors on or in the body of the transducer and which are operable to acquire data regarding various parameters or characteristics of the surrounding environment such as temperature, pressure, orientation, forces acting on the body, etc. Such sensors are conventional in form and operation and do not require a detailed explanation herein. The sensor system preferably includes a transmitter to allow the data to be wireless or otherwise transmitted from the transducer.

The sensor system would preferably incorporate an energy capture take off system operable to convert the rotational displacement of the body as hereinbefore described into electrical energy in order to power the various sensors, transmitter, and related electrical components. In this way the sensor system could be operational for prolonged periods of time, which is of significant benefit in marine environments.

The invention claimed is:

1. A buoyant rotatable marine transducer comprising a body adapted to assume a first orientation when at least partially submerged in a body of water and unloaded, in which a longitudinal axis of the body is disposed in a nominal orientation; first and second mooring connection points at least one of which comprises a rigid arm pivotally connected to the body; wherein the first mooring connection point and the second mooring connection point are positioned such that respective loads applied via the first mooring connection point and the second mooring connection point to the body acts off axis of the longitudinal axis; wherein the first and second mooring connection points are positioned opposed but longitudinally offset to one another and at least one of the first mooring connection point and the second mooring connection point is located intermediate a first end and a second end of the body such that the loads applied via the mooring connection points together act to effect rotation of the body.

2. The buoyant rotatable marine transducer according to claim 1 in which the body is adapted to undergo displacement when a load is applied to the body via the first and second mooring connection points and to return to the first orientation when the load is removed.

3. The buoyant rotatable marine transducer according to claim 1 in which the body is shaped to maximize and/or control drag during displacement of the body under the influence of the applied load.

4. The buoyant rotatable marine transducer according to claim 1 in which the body is shaped to minimize and/or control drag during return of the body to the first orientation.

5. The buoyant rotatable marine transducer according to claim 1 in which the body is adapted to undergo rotational displacement about an axis of rotation extending through a point within or outside the body.

6. The buoyant rotatable marine transducer according to claim 1 in which the second mooring connection point is positioned such that a load applied via the second mooring connection point to the body acts off axis of the longitudinal axis.

7. The buoyant rotatable marine transducer according to claim 1 in which the location of at least the first mooring connection point on the body is adjustable.

8. The buoyant rotatable marine transducer according to claim 7 in which the location of the first mooring connection point is adjustable longitudinally and/or radially of the body.

9. The buoyant rotatable marine transducer according to claim 1 in which the location of the second mooring connection point on the body is adjustable.

10. The buoyant rotatable marine transducer according to claim 9 in which the location of the second mooring connection point is adjustable longitudinally and/or radially of the body.

11. The buoyant rotatable marine transducer according to claim 1 in which the location of at least the first mooring connection point is longitudinally spaced from a center of gravity of the body.

12. The buoyant rotatable marine transducer according to claim 1 in which the location of at least the first mooring connection point is longitudinally spaced from a center of buoyancy of the body.

13. The buoyant rotatable marine transducer according to claim 1 in which the location of the second mooring connection point is longitudinally spaced from the center of gravity of the body.

14. The buoyant rotatable marine transducer according to claim 1 in which the location of the second mooring connection point is longitudinally spaced from the center of buoyancy of the body.

15. The buoyant rotatable marine transducer according to claim 1 in which the first and second mooring connection points, the center of gravity of the body and the center of buoyancy of the body are arranged in a linear array.

16. The buoyant rotatable marine transducer according to claim 1 in which the body is neutrally buoyant.

17. The buoyant rotatable marine transducer according to claim 1 in which the body is positively buoyant.

18. The buoyant rotatable marine transducer according to claim 1 in which the body is negatively buoyant.

19. The buoyant rotatable marine transducer according to claim 1 in which the body comprises a weighted portion.

20. The buoyant rotatable marine transducer according to claim 1 in which the body comprises a buoyant portion.

21. The buoyant rotatable marine transducer according to claim 1 in which the body comprises a buoyant portion and a weighted portion.

22. The buoyant rotatable marine transducer according to claim 19 in which the buoyant portion and the weighted portion are positioned to establish a force couple which together act to restore the body towards the first orientation.

23. The buoyant rotatable marine transducer according to claim 19 in which the buoyant portion and the weighted portion are longitudinally spaced from one another.

24. The buoyant rotatable marine transducer according to claim 1 in which the buoyancy of the body is adjustable.

25. The buoyant rotatable marine transducer according to claim 1 comprising an energy capture take off system.

26. The buoyant rotatable marine transducer according to claim 25 in which the energy capture take off system is operable to generate electrical energy in response to rotation of the body.

27. The buoyant rotatable marine transducer according to claim 26 in which the electrical energy supplies one or more powered components provided in or on the marine transducer.

28. The buoyant rotatable marine transducer according to claim 1 comprising one or more sensors.

29. The buoyant rotatable marine transducer according to claim 28 comprising a transmitter operable to wirelessly transmit data acquired from the one or more sensors.

30. The buoyant rotatable marine transducer according to claim 1 in which the body comprises two or more sections.

31. The buoyant rotatable marine transducer according to claim 30 in which at least one of the body sections is articulated relative to another body section.

32. The buoyant rotatable marine transducer according to claim 1 comprising one or more springs arranged for compression in response to rotation of the body.

33. The buoyant rotatable marine transducer according to claim 1 in which the body defines a passage extending between the first and second mooring connection points.

34. The buoyant rotatable marine transducer according to claim 33 in which one or both ends of the passage terminate in a bend restrictor.

35. The buoyant rotatable marine transducer according to claim 33 in which the body is openable to permit exterior access to the full length of the passage.

36. The buoyant rotatable marine transducer according to claim 1 in which the position of one or more of the mooring connection points and/or a level or position of ballast in the body and/or a level or position of buoyancy of the body are dynamically controllable autonomously and/or in response to a signal from the one or more of the sensors and/or in response to external information.

37. A load reduction device for reducing or managing the load or tension in a mooring line securing a floating platform, the load reduction device comprising a buoyant rotatable marine transducer comprising a body adapted to assume a first orientation when at least partially submerged in a body of water and unloaded, in which a longitudinal axis of the body is disposed in a nominal orientation: first and second mooring connection points at least one of which comprises a rigid arm pivotally connected to the body; wherein the first mooring connection point and the second mooring connection point are positioned such that respective loads applied via the first mooring connection point and the second mooring connection point to the body acts off axis of the longitudinal axis; wherein the first and second mooring connection points are positioned opposed but longitudinally offset to one another and at least one of the first mooring connection point and the second mooring connection point is located intermediate a first end and a second end of the body such that the loads applied via the mooring connection points together act to effect rotation of the body.

38. A load reduction system for securing a floating structure, the load reduction system comprising at least one buoyant rotatable marine transducer comprising a body adapted to assume a first orientation when at least partially submerged in a body of water and unloaded, in which a longitudinal axis of the body is disposed in a nominal orientation: first and second mooring connection points at least one of which comprises a rigid arm pivotally connected to the body, wherein the first mooring connection point and the second mooring connection point are positioned such that respective loads applied via the first mooring connection point and the second mooring connection point to the body acts off axis of the longitudinal axis; wherein the first and second mooring connection points are positioned opposed but longitudinally offset to one another and at least one of the first mooring connection point and the second mooring connection point is located intermediate a first end and a second end of the body such that the loads applied via the mooring connection points together act to effect rotation of the body; a first mooring line connected between the floating structure and the body of the buoyant rotatable marine transducer; and a second mooring line connected between the body of the buoyant rotatable marine transducer and an anchor.

39. A floating platform comprising at least one rotatable buoyant marine transducer, comprising a body adapted to assume a first orientation when at least partially submerged in a body of water and unloaded, in which a longitudinal axis of the body is disposed in a nominal orientation: first and second mooring connection points at least one of which comprises a rigid arm pivotally connected to the body: wherein the first mooring connection point and the second mooring connection point are positioned such that respective loads applied via the first mooring connection point and the second mooring connection point to the body acts off axis of the longitudinal axis; wherein the first and second mooring connection points are positioned opposed but longitudinally offset to one another and at least one of the first mooring connection point and the second mooring connection point is located intermediate a first end and a second end of the body such that the loads applied via the mooring connection points together act to effect rotation of the body, the rotatable buoyant marine transducer formed integrally, with the floating platform wherein the rotatable buoyant marine transducer is rotatably mounted to the platform at one of the first or second mooring connection points.

40. The floating platform according to claim 39 in which the body of the rotatable buoyant marine transducer comprises a buoyant portion above the first mooring connection point or the second mooring connection point at which the body is rotatably mounted to the platform and/or a weighted portion below the first mooring connection point or the second mooring connection point at which the body is rotatably mounted to the platform.

41. The floating platform according to claim 39 in which the body of the at least one rotatable buoyant marine transducer comprises an effective amount of the buoyancy required to float the floating platform.

42. A sensor system comprising at least one rotatable buoyant marine transducer comprising a body adapted to assume a first orientation when at least partially submerged in a body of water and unloaded, in which a longitudinal axis of the body is disposed in a nominal orientation: first and second mooring connection points at least one of which comprises a rigid arm pivotally connected to the body; wherein the first mooring connection point and the second mooring connection point are positioned such that respective loads applied via the first mooring connection point and the second mooring connection point to the body acts off axis of the longitudinal axis; wherein the first and second mooring connection points are positioned opposed but longitudinally offset to one another and at least one of the first mooring connection point and the second mooring connection point is located intermediate a first end and a second end of the body such that the loads applied via the mooring connection points together act to effect rotation of the body.

43. A method of mooring a floating platform comprising the steps of securing one or more rotatable buoyant marine transducers to the floating platform, the one or more rotatable buoyant marine transducers comprising a body adapted to assume a first orientation when at least partially submerged in a body of water and unloaded, in which a longitudinal axis of the body is disposed in a nominal orientation; first and second mooring connection points at least one of which comprises a rigid arm pivotally connected to the body; wherein the first mooring connection point and the second mooring connection point are positioned such that respective loads applied via the first mooring connection point and the second mooring connection point to the body acts off axis of the longitudinal axis; wherein the first and second mooring connection points are positioned opposed but longitudinally offset to one another and at least one of the first mooring connection point and the second mooring connection point is located intermediate a first end and a second end of the body such that the loads applied via the mooring connection points together act to effect rotation of the body; wherein the method comprises securing the one or more rotatable buoyant marine transducers to the floating platform via one of the first mooring connection point and the second mooring connection points; and anchoring the at least one rotatable buoyant marine transducer via the other of the first mooring connection points and the second mooring connection point.

44. The mooring method according to claim 43 comprising the steps of temporarily securing the body in an orientation in which the body is rotated out of equilibrium prior to securing to the floating platform; securing the body to the floating platform under a low line tension; and releasing the body from the out of equilibrium orientation.

45. The mooring method according to claim 43 in which the body of each of the one or more rotatable buoyant marine transducers comprises a ballast tank defining a weighted portion of the body and a buoyancy tank defining a buoyant portion of the body, the method comprising the steps of locating the one or more rotatable buoyant marine transducer in a body of water at or adjacent a deployment site in an un-ballasted state and with the buoyancy tank at least partially filled with air or water; anchoring the at least one rotatable buoyant marine transducer via one of the first mooring connection points and the second mooring connection point; securing the one or more rotatable buoyant marine transducer to the floating platform via the other of the first mooring connection points and the second mooring connection point; displacing ballast into the ballast tank; and displacing water out or air into the buoyancy tank.

46. The mooring method according to claim 43 in which the body of each of the one or more rotatable buoyant marine transducers is secured such that a mooring line extending between an anchor and the body and a mooring line extending between the body and the floating platform each extend substantially vertically.

47. The mooring method according to claim 46 comprising the step of tuning a stiffness curve of the at least one rotatable buoyant marine transducer such that the body of the rotatable buoyant marine transducer rotates in response to tidal range variation the line tension between the rotatable buoyant marine transducer and the floating platform remains substantially unchanged.

* * * * *